US011336002B2

(12) United States Patent
Park et al.

(10) Patent No.: US 11,336,002 B2
(45) Date of Patent: May 17, 2022

(54) ANTENNA AND ELECTRONIC DEVICE INCLUDING THE SAME

(71) Applicant: Samsung Electronics Co., Ltd., Suwon-si (KR)

(72) Inventors: Seongjin Park, Suwon-si (KR); Dongyeon Kim, Suwon-si (KR); Hosaeng Kim, Suwon-si (KR); Sumin Yun, Suwon-si (KR); Woomin Jang, Suwon-si (KR); Myunghun Jeong, Suwon-si (KR); Jehun Jong, Suwon-si (KR); Jaehoon Jo, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 9 days.

(21) Appl. No.: 17/089,014

(22) Filed: Nov. 4, 2020

(65) Prior Publication Data

US 2021/0143536 A1 May 13, 2021

(30) Foreign Application Priority Data

Nov. 8, 2019 (KR) ..... 10-2019-0142491

(51) Int. Cl.

| | |
|---|---|
| ***H01Q 1/38*** | (2006.01) |
| ***H01Q 1/24*** | (2006.01) |
| ***H01Q 21/28*** | (2006.01) |
| ***H01Q 21/06*** | (2006.01) |

(52) U.S. Cl.

CPC ..... *H01Q 1/38* (2013.01); *H01Q 1/243* (2013.01); *H01Q 21/065* (2013.01); *H01Q 21/28* (2013.01)

(58) Field of Classification Search

CPC ..... H01Q 21/28; H01Q 21/065; H01Q 1/243; H01Q 1/38

See application file for complete search history.

(56) References Cited

U.S. PATENT DOCUMENTS

| | | | |
|---|---|---|---|
| 10,103,424 | B2 | 10/2018 | Noori et al. |
| 10,840,583 | B2 | 11/2020 | Lee et al. |
| 11,075,444 | B2 | 7/2021 | Jeon et al. |
| 2013/0016023 | A1 | 1/2013 | Gaucher et al. |

(Continued)

FOREIGN PATENT DOCUMENTS

| | | | |
|---|---|---|---|
| KR | 10-2017-0000695 | A | 1/2017 |
| KR | 10-2019-0060283 | A | 6/2019 |
| KR | 10-2019-0061161 | A | 6/2019 |

OTHER PUBLICATIONS

International Search Report dated Feb. 1, 2021, issued in International Application No. PCT/KR2020/014594.

*Primary Examiner* — Graham P Smith

(74) *Attorney, Agent, or Firm* — Jefferson IP Law, LLP

(57) ABSTRACT

An electronic device is provided. The electronic device includes a housing having an inner space. The electronic device may further include an antenna structure disposed in the inner space of the housing and including a printed circuit board (PCB) having a first board surface facing a first direction, a second board surface facing a second direction opposite to the first direction, and a lateral board surface surrounding a space between the first and second board surfaces, a first antenna array disposed in the space between the first and second board surfaces and forming a beam pattern in a third direction that the lateral board surface faces, and a second antenna array disposed at a position spaced apart from the first antenna array and forming a beam pattern in the first direction.

20 Claims, 33 Drawing Sheets

(56) References Cited

U.S. PATENT DOCUMENTS

| | | | |
|---|---|---|---|
| 2019/0006751 | A1 | 1/2019 | Chen et al. |
| 2019/0267710 | A1 | 8/2019 | Jenwatanavet et al. |
| 2019/0334225 | A1 | 10/2019 | Lee et al. |
| 2020/0358202 | A1 | 11/2020 | Yun et al. |

ANTENNA AND ELECTRONIC DEVICE INCLUDING THE SAME

CROSS-REFERENCE TO RELATED APPLICATION(S)

This application is based on and claims priority under 35 U.S.C. § 119(a) of a Korean patent application number 10-2019-0142491, filed on Nov. 8, 2019, in the Korean Intellectual Property Office, the disclosures of which is incorporated by reference herein in its entirety.

BACKGROUND

1. Field

The disclosure relates to an antenna and an electronic device including the same.

2. Description of Related Art

With the development of wireless communication technology, electronic devices, such as smart phones are widely used in everyday life, and thus the use of contents is increasing exponentially. Due to the rapid increase in the use of contents, the network capacity is gradually reaching the limit, and after the commercialization of 4th-generation (4G) communication systems, next-generation communication systems (e.g., a 5th-generation (5G) communication system, a pre-5G communication system, or a new radio (NR) communication system) using a super-high frequency (e.g., mmWave) band (e.g., 3 GHz to 300 GHz band) is now studied in order to satisfy the increasing demands of radio data traffic.

Next-generation wireless communication technologies are currently developed to permit signal transmission/reception using frequencies in the range of 3 GHz to 100 GHz, overcome a high free space loss due to frequency characteristics, implement an efficient mounting structure for increasing an antenna gain, and realize a related new antenna structure. This antenna structure may include an array antenna in which at least one antenna element (e.g., at least one conductive pattern and/or at least one conductive patch) are arranged at regular intervals on a printed circuit board (PCB). These antenna elements may be disposed in an electronic device so as to form a beam pattern in at least one direction. In addition, the electronic device may include a conductive structure (e.g., a conductive lateral member or a display formed as a portion of a housing) disposed at least in part around the antenna structure so as to reinforce the rigidity and create a beautiful appearance.

However, when such a conductive structure is located in a direction of the beam pattern formed by at least one antenna element of the antenna structure, the radiation direction of the antenna structure may be changed and/or distorted in any undesired direction due to the conductive structure. Unfortunately, this may cause the degradation of the antenna radiation performance.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide an antenna and an electronic device including the same.

Another aspect of the disclosure is to provide an antenna implemented to prevent the degradation of radiation performance even if a conductive structure is disposed nearby, and also provide an electronic device including the antenna.

Another aspect of the disclosure is to provide an antenna configured to form a beam pattern in a desired direction based on an arrangement in an inner space of an electronic device, and also provide an electronic device including the antenna.

Additional aspects will be set forth in part in the description which follows and, in part, will be apparent from the description, or may be learned by practice of the presented embodiments.

In accordance with an aspect of the disclosure, an electronic device is provided. The electronic device includes a housing having an inner space. The electronic device may further include an antenna structure disposed in the inner space of the housing and including a printed circuit board (PCB) having a first board surface facing a first direction, a second board surface facing a second direction opposite to the first direction, and a lateral board surface surrounding a space between the first and second board surfaces, a first antenna array disposed in the space between the first and second board surfaces and forming a beam pattern in a third direction that the lateral board surface faces, and a second antenna array disposed at a position spaced apart from the first antenna array and forming a beam pattern in the first direction. The electronic device may further include a conductor including a conductive portion and disposed between the first and second antenna arrays in the inner space of the housing when the first board surface is viewed from above. The electronic device may further include a first wireless communication circuit disposed in the inner space of the housing and configured to transmit and/or receive a radio signal of a first frequency range through the first and second antenna arrays.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features and advantages of certain embodiments of the disclosure will be more apparent from the following description taken in conjunction with the accompanying drawings, in which.

The same reference numerals are used to represent the same elements throughout the drawings.

DETAILED DESCRIPTION

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
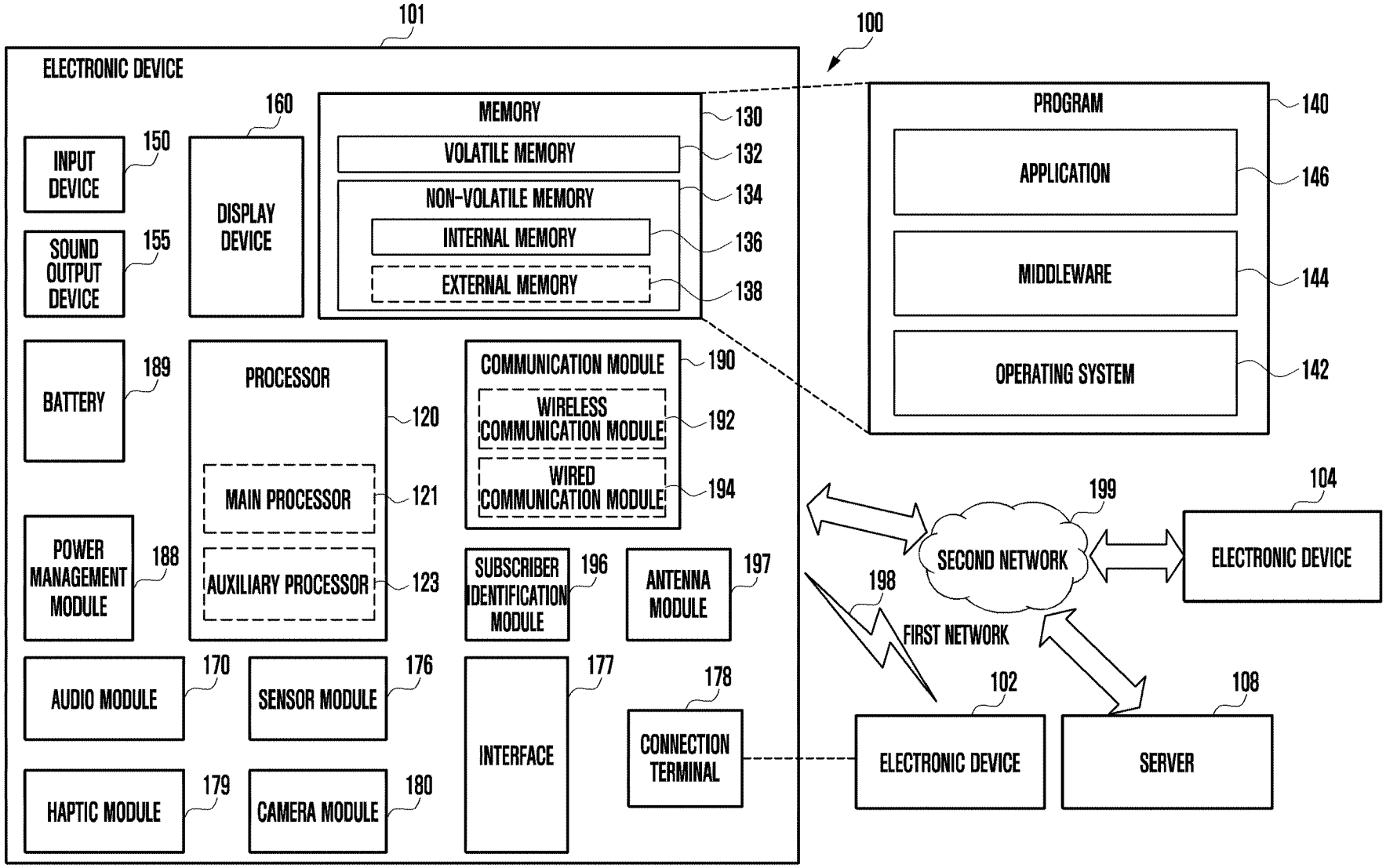
FIG. 1 is a block diagram illustrating an electronic device in a network environment according to an embodiment of the disclosure.

FIG. 1 illustrates an electronic device in a network environment according to an embodiment of the disclosure.

Referring to FIG. 1, an electronic device 101 in a network environment 100 may communicate with an electronic device 102 via a first network 198 (e.g., a short-range wireless communication network), or an electronic device 104 or a server 108 via a second network 199 (e.g., a long-range wireless communication network). The electronic device 101 may communicate with the electronic device 104 via the server 108. The electronic device 101 includes a processor 120, a memory 130, an input device 150, an audio output device 155, a display device 160, an audio module 170, a sensor module 176, an interface 177, a haptic module 179, a camera module 180, a power management module 188, a battery 189, a communication module 190, a subscriber identification module (SIM) 196, or an antenna module 197. In some embodiments of the disclosure, at least one (e.g., the display device 160 or the camera module 180) of the components may be omitted from the electronic device 101, or one or more other components may be added in the electronic device 101. In some embodiments of the disclosure, some of the components may be implemented as single integrated circuitry. For example, the sensor module 176 (e.g., a fingerprint sensor, an iris sensor, or an illuminance sensor) may be implemented as embedded in the display device 160 (e.g., a display).

The processor 120 may execute, for example, software (e.g., a program 140) to control at least one other component (e.g., a hardware or software component) of the electronic device 101 coupled with the processor 120, and may perform various data processing or computation. As at least part of the data processing or computation, the processor 120 may load a command or data received from another component (e.g., the sensor module 176 or the communication module 190) in volatile memory 132, process the command or the data stored in the volatile memory 132, and store resulting data in non-volatile memory 134. The processor 120 may include a main processor 121 (e.g., a central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of functions or states related to at least one component (e.g., the display device 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). The auxiliary processor 123 (e.g., an ISP or a CP) may be implemented as part of another component (e.g., the camera module 180 or the communication module 190) functionally related to the auxiliary processor 123.

The memory 130 may store various data used by at least one component (e.g., the processor 120 or the sensor module 176) of the electronic device 101. The various data may include, for example, software (e.g., the program 140) and input data or output data for a command related thereto. The memory 130 may include the volatile memory 132 or the non-volatile memory 134.

The program 140 may be stored in the memory 130 as software, and may include, for example, an operating system (OS) 142, middleware 144, or an application 146.

The input device 150 may receive a command or data to be used by other component (e.g., the processor 120) of the electronic device 101, from the outside (e.g., a user) of the electronic device 101. The input device 150 may include, for example, a microphone, a mouse, a keyboard, or a digital pen (e.g., a stylus pen).

The audio output device 155 may output sound signals to the outside of the electronic device 101. The audio output device 155 may include, for example, a speaker or a receiver. The speaker may be used for general purposes, such as playing multimedia or playing record, and the receiver may be used for an incoming calls. The receiver may be implemented as separate from, or as part of the speaker.

The display device 160 may visually provide information to the outside (e.g., a user) of the electronic device 101. The display device 160 may include, for example, a display, a hologram device, or a projector and control circuitry to control a corresponding one of the display, hologram device, and projector. The display device 160 may include touch circuitry adapted to detect a touch, or sensor circuitry (e.g., a pressure sensor) adapted to measure the intensity of force incurred by the touch.

The audio module 170 may convert a sound into an electrical signal and vice versa. The audio module 170 may obtain the sound via the input device 150, or output the sound via the audio output device 155 or a headphone of an external electronic device (e.g., an electronic device 102) directly (e.g., wiredly) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. The sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., wiredly) or wirelessly. The interface 177 may include, for example, a high definition multimedia interface (HDMI), a universal serial bus (USB) interface, a secure digital (SD) card interface, or an audio interface.

A connection terminal 178 may include a connector via which the electronic device 101 may be physically connected with the external electronic device (e.g., the electronic device 102). The connection terminal 178 may include, for example, a HDMI connector, a USB connector, a SD card connector, or an audio connector (e.g., a headphone connector).

The haptic module 179 may convert an electrical signal into a mechanical stimulus (e.g., a vibration or a movement) or electrical stimulus which may be recognized by a user via his tactile sensation or kinesthetic sensation. The haptic module 179 may include, for example, a motor, a piezoelectric element, or an electric stimulator.

The camera module 180 may capture an image or moving images. The camera module 180 may include one or more lenses, image sensors, image signal processors, or flashes.

The power management module 188 may manage power supplied to the electronic device 101. The power management module 188 may be implemented as at least part of, for example, a power management integrated circuit (PMIC).

The battery 189 may supply power to at least one component of the electronic device 101. The battery 189 may include, for example, a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more communication processors that are operable independently from the processor 120 (e.g., the AP) and supports a direct (e.g., wired) communication or a wireless communication. The communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via the first network 198 (e.g., a short-range communication network, such as Bluetooth™, wireless-fidelity (Wi-Fi) direct, or infrared data association (IrDA)) or the second network 199 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 192 may identify and authenticate the electronic device 101 in a communication network, such as the first network 198 or the second network 199, using subscriber information (e.g., international mobile subscriber identity (IMSI)) stored in the SIM 196.

The antenna module 197 may transmit or receive a signal or power to or from the outside (e.g., the external electronic device) of the electronic device 101. The antenna module 197 may include an antenna including a radiating element including a conductive material or a conductive pattern formed in or on a substrate (e.g., a printed circuit board (PCB)). The antenna module 197 may include a plurality of antennas. In such a case, at least one antenna appropriate for a communication scheme used in the communication network, such as the first network 198 or the second network 199, may be selected, for example, by the communication module 190 (e.g., the wireless communication module 192) from the plurality of antennas. The signal or the power may then be transmitted or received between the communication module 190 and the external electronic device via the selected at least one antenna. Another component (e.g., a radio frequency integrated circuit (RFIC)) other than the radiating element may be additionally formed as part of the antenna module 197.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

Commands or data may be transmitted or received between the electronic device 101 and the external electronic device 104 via the server 108 coupled with the second network 199. Each of the electronic devices 102 and 104 may be a device of a same type as, or a different type, from the electronic device 101. All or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, or client-server computing technology may be used, for example.

An electronic device according to an embodiment may be one of various types of electronic devices. The electronic device may include a portable communication device (e.g., a smart phone), a computer device, a portable multimedia device, a portable medical device, a camera, a wearable device, or a home appliance. However, the electronic device is not limited to any of those described above.

Various embodiments of the disclosure and the terms used herein are not intended to limit the technological features set forth herein to particular embodiments and include various changes, equivalents, or replacements for a corresponding embodiment.

With regard to the description of the drawings, similar reference numerals may be used to refer to similar or related elements.

A singular form of a noun corresponding to an item may include one or more of the things, unless the relevant context clearly indicates otherwise. As used herein, each of such phrases as "A or B", "at least one of A and B", "at least one of A or B", "A, B, or C", "at least one of A, B, and C", and "at least one of A, B, or C" may include any one of, or all possible combinations of the items enumerated together in a corresponding one of the phrases.

As used herein, such terms as "1st" and "2nd", or "first" and "second" may be used to simply distinguish a corresponding component from another, and does not limit the components in other aspect (e.g., importance or order). If an element (e.g., a first element) is referred to, with or without the term "operatively" or "communicatively", as "coupled with", "coupled to", "connected with", or "connected to" another element (e.g., a second element), it means that the element may be coupled with the other element directly (e.g., wiredly), wirelessly, or via a third element.

The term "module" may include a unit implemented in hardware, software, or firmware, and may interchangeably be used with other terms, for example, "logic", "logic block", "part", or "circuitry". A module may be a single integral component, or a minimum unit or part thereof, adapted to perform one or more functions. For example, according to an embodiment of the disclosure, the module may be implemented in a form of an application-specific integrated circuit (ASIC).

Various embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a complier or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

A method according to an embodiment of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., PlayStore™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

Each component (e.g., a module or a program) of the above-described components may include a single entity or multiple entities. One or more of the above-described components may be omitted, or one or more other components may be added. Alternatively or additionally, a plurality of components (e.g., modules or programs) may be integrated into a single component. In such a case, the integrated component may perform one or more functions of each of the plurality of components in the same or similar manner as they are performed by a corresponding one of the plurality of components before the integration. Operations performed by the module, the program, or another component may be carried out sequentially, in parallel, repeatedly, or heuristically, or one or more of the operations may be executed in a different order or omitted, or one or more other operations may be added.

Figure 2:
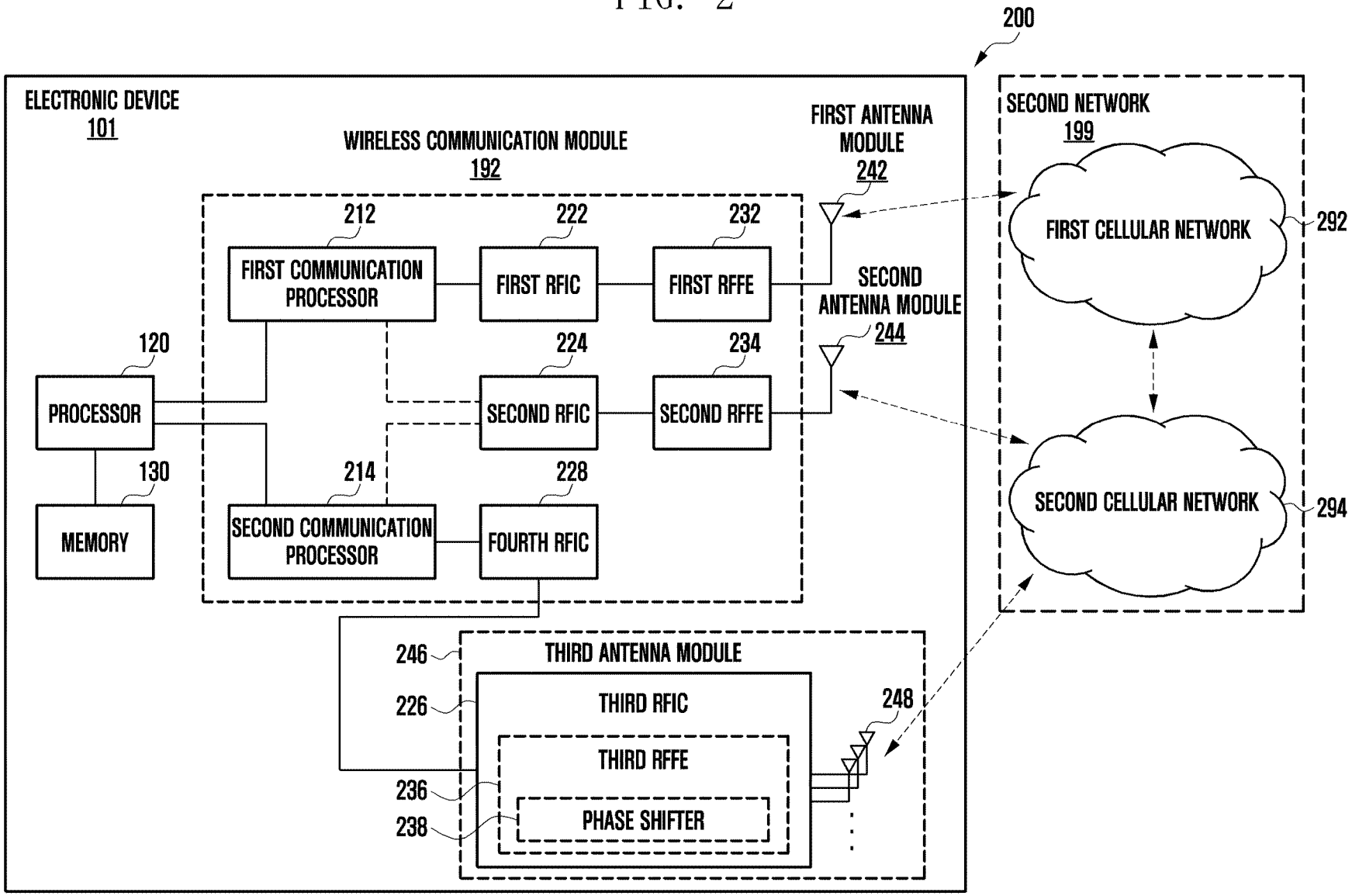
FIG. 2 is a block diagram illustrating an electronic device for supporting a legacy network communication and a 5G network communication according to an embodiment of the disclosure.

FIG. 2 is a block diagram illustrating an electronic device in a network environment including a plurality of cellular networks according to an embodiment of the disclosure.

Referring to FIG. 2, the electronic device 101 may include a first communication processor 212, second communication processor 214, first RFIC 222, second RFIC 224, third RFIC 226, fourth RFIC 228, first radio frequency front end (RFFE) 232, second RFFE 234, first antenna module 242, second antenna module 244, and antenna 248. The electronic device 101 may include a processor 120 and a memory 130. A second network 199 may include a first cellular network 292 and a second cellular network 294. According to another embodiment of the disclosure, the electronic device 101 may further include at least one of the components described with reference to FIG. 1, and the second network 199 may further include at least one other network. According to one embodiment of the disclosure, the first communication processor 212, second communication processor 214, first RFIC 222, second RFIC 224, fourth RFIC 228, first RFFE 232, and second RFFE 234 may form at least part of the wireless communication module 192. According to another embodiment of the disclosure, the fourth RFIC 228 may be omitted or included as part of the third RFIC 226.

The first communication processor 212 may establish a communication channel of a band to be used for wireless communication with the first cellular network 292 and support legacy network communication through the established communication channel According to various embodiments of the disclosure, the first cellular network may be a legacy network including a second generation (2G), 3G, 4G, or long term evolution (LTE) network. The second communication processor 214 may establish a communication channel corresponding to a designated band (e.g., about 6 GHz to about 60 GHz) of bands to be used for wireless communication with the second cellular network 294, and support 5G network communication through the established communication channel According to various embodiments of the disclosure, the second cellular network 294 may be a 5G network defined in 3GPP. Additionally, according to an embodiment of the disclosure, the first communication processor 212 or the second communication processor 214 may establish a communication channel corresponding to another designated band (e.g., about 6 GHz or less) of bands to be used for wireless communication with the second cellular network 294 and support 5G network communication through the established communication channel. According to one embodiment of the disclosure, the first communication processor 212 and the second communication processor 214 may be implemented in a single chip or a single package. According to various embodiments of the disclosure, the first communication processor 212 or the second communication processor 214 may be formed in a single chip or a single package with the processor 120, the auxiliary processor 123, or the communication module 190.

Upon transmission, the first RFIC 222 may convert a baseband signal generated by the first communication processor 212 to a radio frequency (RF) signal of about 700 MHz to about 3 GHz used in the first cellular network 292 (e.g., legacy network). Upon reception, an RF signal may be obtained from the first cellular network 292 (e.g., legacy network) through an antenna (e.g., the first antenna module 242) and be preprocessed through an RFFE (e.g., the first RFFE 232). The first RFIC 222 may convert the preprocessed RF signal to a baseband signal so as to be processed by the first communication processor 212.

Upon transmission, the second RFIC 224 may convert a baseband signal generated by the first communication processor 212 or the second communication processor 214 to an RF signal (hereinafter, 5G Sub6 RF signal) of a Sub6 band (e.g., 6 GHz or less) to be used in the second cellular network 294 (e.g., 5G network). Upon reception, a 5G Sub6 RF signal may be obtained from the second cellular network 294 (e.g., 5G network) through an antenna (e.g., the second antenna module 244) and be pretreated through an RFFE (e.g., the second RFFE 234). The second RFIC 224 may convert the preprocessed 5G Sub6 RF signal to a baseband signal so as to be processed by a corresponding communication processor of the first communication processor 212 or the second communication processor 214.

The third RFIC 226 may convert a baseband signal generated by the second communication processor 214 to an RF signal (hereinafter, 5G Above6 RF signal) of a 5G Above6 band (e.g., about 6 GHz to about 60 GHz) to be used in the second cellular network 294 (e.g., 5G network). Upon reception, a 5G Above6 RF signal may be obtained from the second cellular network 294 (e.g., 5G network) through an antenna (e.g., the antenna 248) and be preprocessed through the third RFFE 236. The third RFIC 226 may convert the preprocessed 5G Above6 RF signal to a baseband signal so as to be processed by the second communication processor 214. According to one embodiment of the disclosure, the third RFFE 236 may be formed as part of the third RFIC 226.

According to an embodiment of the disclosure, the electronic device 101 may include a fourth RFIC 228 separately from the third RFIC 226 or as at least part of the third RFIC 226. In this case, the fourth RFIC 228 may convert a baseband signal generated by the second communication processor 214 to an RF signal (hereinafter, an intermediate frequency (IF) signal) of an intermediate frequency band (e.g., about 9 GHz to about 11 GHz) and transfer the IF signal to the third RFIC 226. The third RFIC 226 may convert the IF signal to a 5G Above 6RF signal. Upon reception, the 5G Above 6RF signal may be received from the second cellular network 294 (e.g., a 5G network) through an antenna (e.g., the antenna 248) and be converted to an IF signal by the third RFIC 226. The fourth RFIC 228 may convert an IF signal to a baseband signal so as to be processed by the second communication processor 214.

According to one embodiment of the disclosure, the first RFIC 222 and the second RFIC 224 may be implemented into at least part of a single package or a single chip. According to one embodiment of the disclosure, the first RFFE 232 and the second RFFE 234 may be implemented into at least part of a single package or a single chip. According to one embodiment of the disclosure, at least one of the first antenna module 242 or the second antenna module 244 may be omitted or may be combined with another antenna module to process RF signals of a corresponding plurality of bands.

According to one embodiment of the disclosure, the third RFIC 226 and the antenna 248 may be disposed at the same substrate to form a third antenna module 246. For example, the wireless communication module 192 or the processor 120 may be disposed at a first substrate (e.g., main PCB). In this case, the third RFIC 226 is disposed in a partial area (e.g., lower surface) of the first substrate and a separate second substrate (e.g., sub PCB), and the antenna 248 is disposed in another partial area (e.g., upper surface) thereof; thus, the third antenna module 246 may be formed. By disposing the third RFIC 226 and the antenna 248 in the same substrate, a length of a transmission line therebetween can be reduced. This may reduce, for example, a loss (e.g., attenuation) of a signal of a high frequency band (e.g., about 6 GHz to about 60 GHz) to be used in 5G network communication by a transmission line. Therefore, the electronic device 101 may improve a quality or speed of communication with the second cellular network 294 (e.g., 5G network).

According to one embodiment of the disclosure, the antenna 248 may be formed in an antenna array including a plurality of antenna elements that may be used for beamforming. In this case, the third RFIC 226 may include a plurality of phase shifters 238 corresponding to a plurality of antenna elements, for example, as part of the third RFFE 236. Upon transmission, each of the plurality of phase shifters 238 may convert a phase of a 5G Above6 RF signal to be transmitted to the outside (e.g., a base station of a 5G network) of the electronic device 101 through a corresponding antenna element. Upon reception, each of the plurality of phase shifters 238 may convert a phase of the 5G Above6 RF signal received from the outside to the same phase or substantially the same phase through a corresponding antenna element. This enables transmission or reception through beamforming between the electronic device 101 and the outside.

The second cellular network 294 (e.g., 5G network) may operate (e.g., stand-alone (SA)) independently of the first cellular network 292 (e.g., legacy network) or may be operated (e.g., non-stand alone (NSA)) in connection with the first cellular network 292. For example, the 5G network may have only an access network (e.g., 5G radio access network (RAN) or a next generation (NG) RAN and have no core network (e.g., next generation core (NGC)). In this case, after accessing to the access network of the 5G network, the electronic device 101 may access to an external network (e.g., Internet) under the control of a core network (e.g., an evolved packed core (EPC)) of the legacy network. Protocol information (e.g., LTE protocol information) for communication with a legacy network or protocol information (e.g., new radio (NR) protocol information) for communication with a 5G network may be stored in the memory 130 to be accessed by other components (e.g., the processor 120, the first communication processor 212, or the second communication processor 214).

Figure 3A:
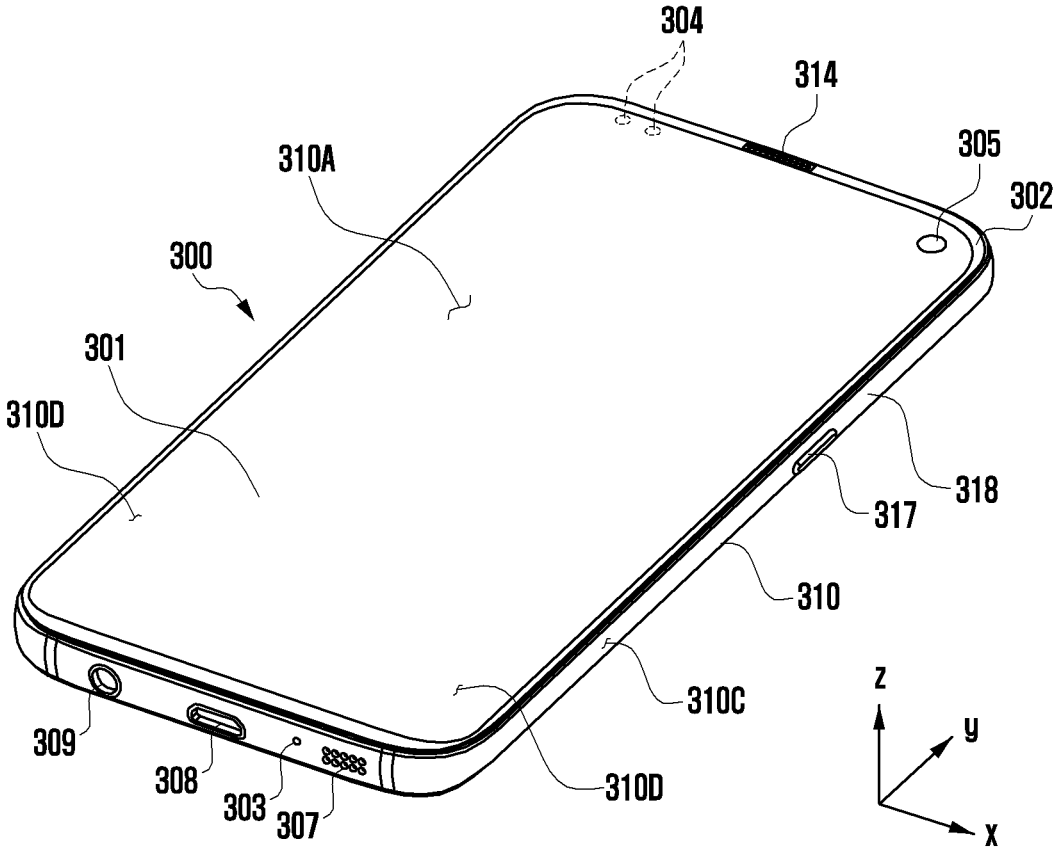
FIG. 3A is a perspective view illustrating a front surface of a mobile electronic device according to an embodiment of the disclosure.
Figure 3B:
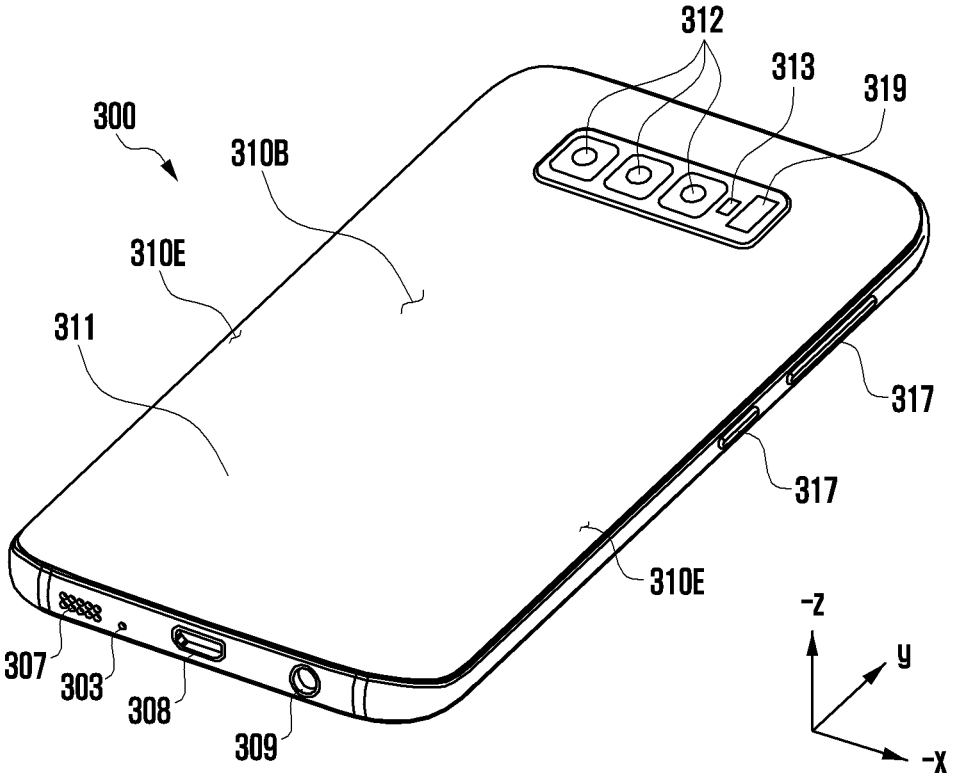
FIG. 3B is a perspective view illustrating a rear surface of a mobile electronic device shown in FIG. 3A according to an embodiment of the disclosure.

FIG. 3A illustrates a perspective view showing a front surface of a mobile electronic device according to an embodiment of the disclosure, and FIG. 3B illustrates a perspective view showing a rear surface of the mobile electronic device shown in FIG. 3A according to an embodiment of the disclosure.

Referring to FIGS. 3A and 3B, a mobile electronic device 300 may include a housing 310 that includes a first surface (or front surface) 310A, a second surface (or rear surface) 310B, and a lateral surface 310C that surrounds a space between the first surface 310A and the second surface 310B. The housing 310 may refer to a structure that forms a part of the first surface 310A, the second surface 310B, and the lateral surface 310C. The first surface 310A may be formed of a front plate 302 (e.g., a glass plate or polymer plate coated with a variety of coating layers) at least a part of which is substantially transparent. The second surface 310B may be formed of a rear plate 311 which is substantially opaque. The rear plate 311 may be formed of, for example, coated or colored glass, ceramic, polymer, metal (e.g., aluminum, stainless steel (STS), or magnesium), or any combination thereof. The lateral surface 310C may be formed of a lateral bezel structure (or "lateral member") 318 which is combined with the front plate 302 and the rear plate 311 and includes a metal and/or polymer. The rear plate 311 and the lateral bezel structure 318 may be integrally formed and may be of the same material (e.g., a metallic material, such as aluminum).

The front plate 302 may include two first regions 310D disposed at long edges thereof, respectively, and bent and extended seamlessly from the first surface 310A toward the rear plate 311. Similarly, the rear plate 311 may include two second regions 310E disposed at long edges thereof, respectively, and bent and extended seamlessly from the second surface 310B toward the front plate 302. The front plate 302 (or the rear plate 311) may include only one of the first regions 310D (or of the second regions 310E). The first regions 310D or the second regions 310E may be omitted in part. When viewed from a lateral side of the mobile electronic device 300, the lateral bezel structure 318 may have a first thickness (or width) on a lateral side where the first region 310D or the second region 310E is not included, and may have a second thickness, being less than the first thickness, on another lateral side where the first region 310D or the second region 310E is included.

The mobile electronic device 300 may include at least one of a display 301, audio modules 303, 307 and 314, sensor modules 304 and 319, camera modules 305, 312 and 313, a key input device 317, a light emitting device, and connector holes 308 and 309. The mobile electronic device 300 may omit at least one (e.g., the key input device 317 or the light emitting device) of the above components, or may further include other components.

The display 301 may be exposed through a substantial portion of the front plate 302, for example. At least a part of the display 301 may be exposed through the front plate 302 that forms the first surface 310A and the first region 310D of the lateral surface 310C. Outlines (i.e., edges and corners) of the display 301 may have substantially the same form as those of the front plate 302. The spacing between the outline of the display 301 and the outline of the front plate 302 may be substantially unchanged in order to enlarge the exposed area of the display 301.

A recess or opening may be formed in a portion of a display area of the display 301 to accommodate at least one of the audio module 314, the sensor module 304, the camera module 305, and the light emitting device. At least one of the audio module 314, the sensor module 304, the camera module 305, a fingerprint sensor (not shown), and the light emitting element may be disposed on the back of the display area of the display 301. The display 301 may be combined with, or adjacent to, a touch sensing circuit, a pressure sensor capable of measuring the touch strength (pressure), and/or a digitizer for detecting a stylus pen. At least a part of the sensor modules 304 and 319 and/or at least a part of the key input device 317 may be disposed in the first region 310D and/or the second region 310E.

The audio modules 303, 307 and 314 may correspond to a microphone hole 303 and speaker holes 307 and 314, respectively. The microphone hole 303 may contain a microphone disposed therein for acquiring external sounds and, in a case, contain a plurality of microphones to sense a sound direction. The speaker holes 307 and 314 may be classified into an external speaker hole 307 and a call receiver hole 314. The microphone hole 303 and the speaker holes 307 and 314 may be implemented as a single hole, or a speaker (e.g., a piezo speaker) may be provided without the speaker holes 307 and 314.

The sensor modules 304 and 319 may generate electrical signals or data corresponding to an internal operating state of the mobile electronic device 300 or to an external environmental condition. The sensor modules 304 and 319 may include a first sensor module 304 (e.g., a proximity sensor) and/or a second sensor module (e.g., a fingerprint sensor) disposed on the first surface 310A of the housing 310, and/or a third sensor module 319 (e.g., a heart rate monitor (HRM) sensor) and/or a fourth sensor module (e.g., a fingerprint sensor) disposed on the second surface 310B of the housing 310. The fingerprint sensor may be disposed on the second surface 310B as well as the first surface 310A (e.g., the display 301) of the housing 310. The electronic device 300 may further include at least one of a gesture sensor, a gyro sensor, an air pressure sensor, a magnetic sensor, an acceleration sensor, a grip sensor, a color sensor, an infrared (IR) sensor, a biometric sensor, a temperature sensor, a humidity sensor, or an illuminance sensor.

The camera modules 305, 312 and 313 may include a first camera device 305 disposed on the first surface 310A of the electronic device 300, and a second camera module 312 and/or a flash 313 disposed on the second surface 310B. The camera module 305 or the camera module 312 may include one or more lenses, an image sensor, and/or an image signal processor. The flash 313 may include, for example, a light emitting diode or a xenon lamp. Two or more lenses (infrared cameras, wide angle and telephoto lenses) and image sensors may be disposed on one side of the electronic device 300.

The key input device 317 may be disposed on the lateral surface 310C of the housing 310. The mobile electronic device 300 may not include some or all of the key input device 317 described above, and the key input device 317 which is not included may be implemented in another form, such as a soft key on the display 301. The key input device 317 may include the sensor module disposed on the second surface 310B of the housing 310.

The light emitting device may be disposed on the first surface 310A of the housing 310. For example, the light emitting device may provide status information of the electronic device 300 in an optical form. The light emitting device may provide a light source associated with the operation of the camera module 305. The light emitting device may include, for example, a light emitting diode (LED), an IR LED, or a xenon lamp.

The connector holes 308 and 309 may include a first connector hole 308 adapted for a connector (e.g., a universal serial bus (USB) connector) for transmitting and receiving power and/or data to and from an external electronic device, and/or a second connector hole 309 adapted for a connector (e.g., an earphone jack) for transmitting and receiving an audio signal to and from an external electronic device.

Some modules 305 of camera modules 305 and 312, some sensor modules 304 of sensor modules 304 and 319, or an indicator may be arranged to be exposed through a display 301. For example, the camera module 305, the sensor module 304, or the indicator may be arranged in the internal space of an electronic device 300 so as to be brought into contact with an external environment through an opening of the display 301, which is perforated up to a front plate 302. In another embodiment of the disclosure, some sensor modules 304 may be arranged to perform their functions without being visually exposed through the front plate 302 in the internal space of the electronic device. For example, in this case, an area of the display 301 facing the sensor module may not require a perforated opening.

Figure 3C:
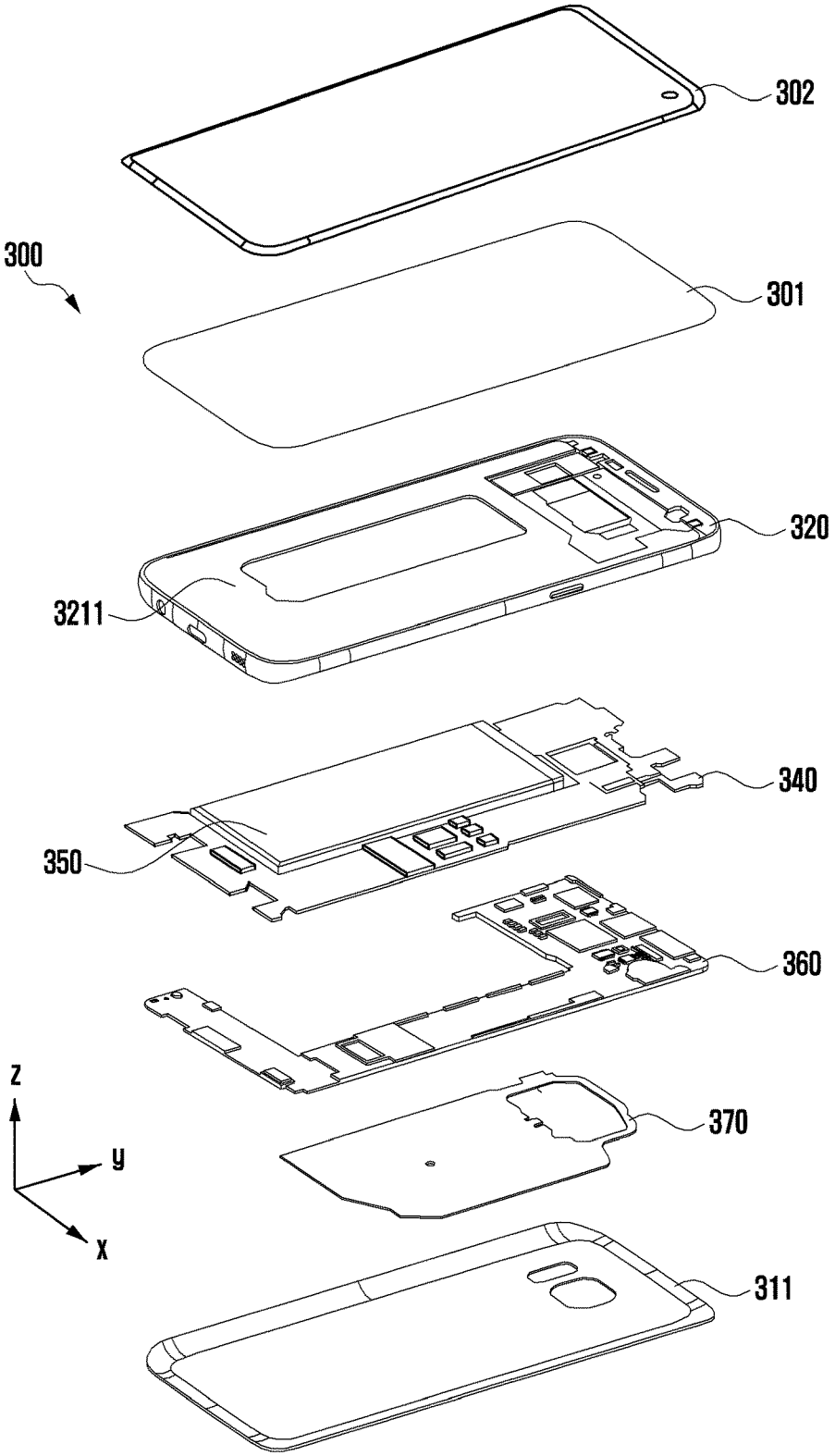
FIG. 3C is an exploded perspective view illustrating a mobile electronic device shown in FIGS. 3A and 3B according to an embodiment of the disclosure.

FIG. 3C illustrates an exploded perspective view showing a mobile electronic device shown in FIG. 3A according to an embodiment of the disclosure.

Referring to FIG. 3C a mobile electronic device 300 may include a lateral bezel structure 320, a first support member 3211 (e.g., a bracket), a front plate 302, a display 301, an electromagnetic induction panel (not shown), a printed circuit board (PCB) 340, a battery 350, a second support member 360 (e.g., a rear case), an antenna 370, and a rear plate 311. The mobile electronic device 300 may omit at least one (e.g., the first support member 3211 or the second support member 360) of the above components or may further include another component. Some components of the electronic device 300 may be the same as or similar to those of the mobile electronic device 101 shown in FIG. 1 or FIG. 2, thus, descriptions thereof are omitted below.

The first support member 3211 is disposed inside the mobile electronic device 300 and may be connected to, or integrated with, the lateral bezel structure 320. The first support member 3211 may be formed of, for example, a metallic material and/or a non-metal (e.g., polymer) material. The first support member 3211 may be combined with the display 301 at one side thereof and also combined with the printed circuit board (PCB) 340 at the other side thereof. On the PCB 340, a processor, a memory, and/or an interface may be mounted. The processor may include, for example, one or more of a central processing unit (CPU), an application processor (AP), a graphics processing unit (GPU), an image signal processor (ISP), a sensor hub processor, or a communications processor (CP).

The memory may include, for example, one or more of a volatile memory and a non-volatile memory.

The interface may include, for example, a high definition multimedia interface (HDMI), a USB interface, a secure digital (SD) card interface, and/or an audio interface. The interface may electrically or physically connect the mobile electronic device 300 with an external electronic device and may include a USB connector, an SD card/multimedia card (MMC) connector, or an audio connector.

The battery 350 is a device for supplying power to at least one component of the mobile electronic device 300, and may include, for example, a non-rechargeable primary battery, a rechargeable secondary battery, or a fuel cell. At least a part of the battery 350 may be disposed on substantially the same plane as the PCB 340. The battery 350 may be integrally disposed within the mobile electronic device 300, and may be detachably disposed from the mobile electronic device 300.

The antenna 370 may be disposed between the rear plate 311 and the battery 350. The antenna 370 may include, for example, a near field communication (NFC) antenna, a wireless charging antenna, and/or a magnetic secure transmission (MST) antenna. The antenna 370 may perform short-range communication with an external device, or transmit and receive power required for charging wirelessly. An antenna structure may be formed by a part or combination of the lateral bezel structure 320 and/or the first support member 3211.

Figure 4A:
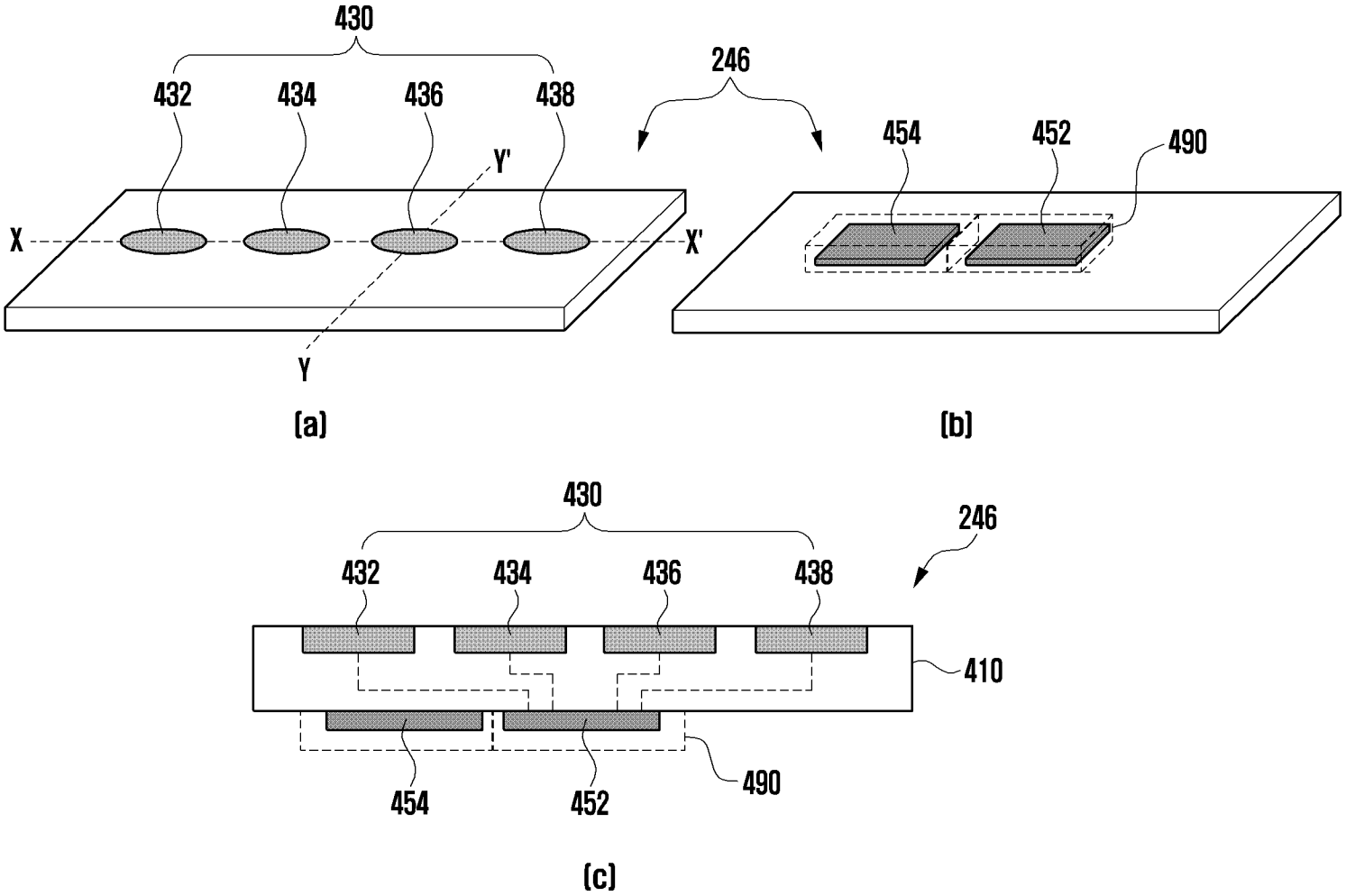
FIG. 4A is a diagram illustrating an embodiment of a structure of a third antenna module shown in and described with reference to FIG. 2 according to an embodiment of the disclosure.

FIG. 4A is a diagram illustrating an embodiment of a structure of a third antenna module described with reference to FIG. 2 according to an embodiment of the disclosure.

Referring to FIG. 4A, (a) is a perspective view illustrating the third antenna module 246 viewed from one side, and referring to FIG. 4A, (b) is a perspective view illustrating the third antenna module 246 viewed from the other side.

Referring to FIG. 4A, (c) is a cross-sectional view illustrating the third antenna module 246 taken along line X-X' of FIG. 4A.

With reference to FIG. 4A, in one embodiment of the disclosure, the third antenna module 246 may include a printed circuit board 410, an antenna array 430, a RFIC 452, and a PMIC 454. Alternatively, the third antenna module 246 may further include a shield member 490. In other embodiments of the disclosure, at least one of the above-described components may be omitted or at least two of the components may be integrally formed.

The printed circuit board 410 may include a plurality of conductive layers and a plurality of non-conductive layers stacked alternately with the conductive layers. The printed circuit board 410 may provide electrical connections between the printed circuit board 410 and/or various electronic components disposed outside using wirings and conductive vias formed in the conductive layer.

The antenna array 430 (e.g., 248 of FIG. 2) may include a plurality of antenna elements 432, 434, 436, or 438 disposed to form a directional beam. As illustrated, the antenna elements 432, 434, 436, or 438 may be formed at a first surface of the printed circuit board 410. According to another embodiment of the disclosure, the antenna array 430 may be formed inside the printed circuit board 410. According to the embodiment of the disclosure, the antenna array 430 may include the same or a different shape or kind of a plurality of antenna arrays (e.g., dipole antenna array and/or patch antenna array).

The RFIC 452 (e.g., the third RFIC 226 of FIG. 2) may be disposed at another area (e.g., a second surface opposite to the first surface) of the printed circuit board 410 spaced apart from the antenna array. The RFIC 452 is configured to process signals of a selected frequency band transmitted/received through the antenna array 430. According to one embodiment of the disclosure, upon transmission, the RFIC 452 may convert a baseband signal obtained from a communication processor (not shown) to an RF signal of a designated band. Upon reception, the RFIC 452 may convert an RF signal received through the antenna array 430 to a baseband signal and transfer the baseband signal to the communication processor.

According to another embodiment of the disclosure, upon transmission, the RFIC 452 may up-convert an IF signal (e.g., about 9 GHz to about 11 GHz) obtained from an intermediate frequency integrate circuit (IFIC) (e.g., 228 of FIG. 2) to an RF signal of a selected band. Upon reception, the RFIC 452 may down-convert the RF signal obtained through the antenna array 430, convert the RF signal to an IF signal, and transfer the IF signal to the IFIC.

The PMIC 454 may be disposed in another partial area (e.g., the second surface) of the printed circuit board 410 spaced apart from the antenna array 430. The PMIC 454 may receive a voltage from a main PCB (not illustrated) to provide power necessary for various components (e.g., the RFIC 452) on the antenna module.

The shielding member 490 may be disposed at a portion (e.g., the second surface) of the printed circuit board 410 so as to electromagnetically shield at least one of the RFIC 452 or the PMIC 454. According to one embodiment of the disclosure, the shield member 490 may include a shield can.

Although not shown, in various embodiments of the disclosure, the third antenna module 246 may be electrically connected to another printed circuit board (e.g., main circuit board) through a module interface. The module interface may include a connecting member, for example, a coaxial cable connector, board to board connector, interposer, or flexible printed circuit board (FPCB). The RFIC 452 and/or the PMIC 454 of the antenna module may be electrically connected to the printed circuit board through the connection member.

Figure 4B:
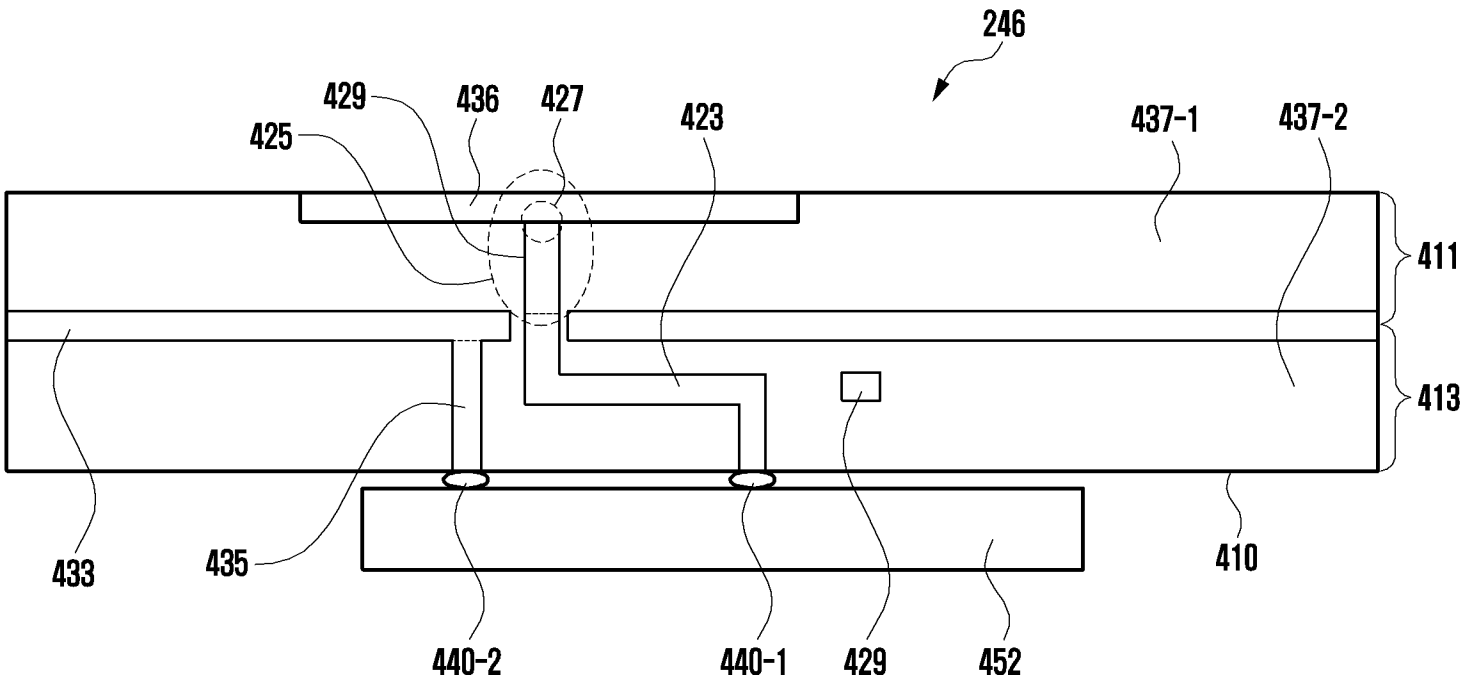
FIG. 4B is a cross-sectional view taken along a line Y-Y' in FIG. 4A according to an embodiment of the disclosure.

FIG. 4B is a cross-sectional view illustrating a third antenna module 246 taken along line Y-Y' of FIG. 4A according to an embodiment of the disclosure. The printed circuit board 410 of the illustrated embodiment may include an antenna layer 411 and a network layer 413 according to an embodiment of the disclosure.

Referring to FIG. 4B, the antenna layer 411 may include at least one dielectric layer 437-1, and an antenna element 436 and/or a power feeding portion 425 formed on or inside an outer surface of a dielectric layer. The power feeding portion 425 may include a power feeding point 427 and/or a power feeding line 429.

The network layer 413 may include at least one dielectric layer 437-2, at least one ground layer 433, at least one conductive via 435, a transmission line 423, and/or a power feeding line 429 formed on or inside an outer surface of the dielectric layer.

Further, in the illustrated embodiment of the disclosure, the RFIC 452 (e.g., the third RFIC 226 of FIG. 2) of FIG. 4A(c) may be electrically connected to the network layer 413 through, for example, first and second solder bumps 440-1 and 440-2. In other embodiments of the disclosure, various connection structures (e.g., solder or ball grid array (BGA)) instead of the solder bumps may be used. The RFIC 452 may be electrically connected to the antenna element 436 through the first solder bump 440-1, the transmission line 423, and the power feeding portion 425. The RFIC 452 may also be electrically connected to the ground layer 433 through the second solder bump 440-2 and the conductive via 435. Although not illustrated, the RFIC 452 may also be electrically connected to the above-described module interface through the power feeding line 429.

Figure 5:
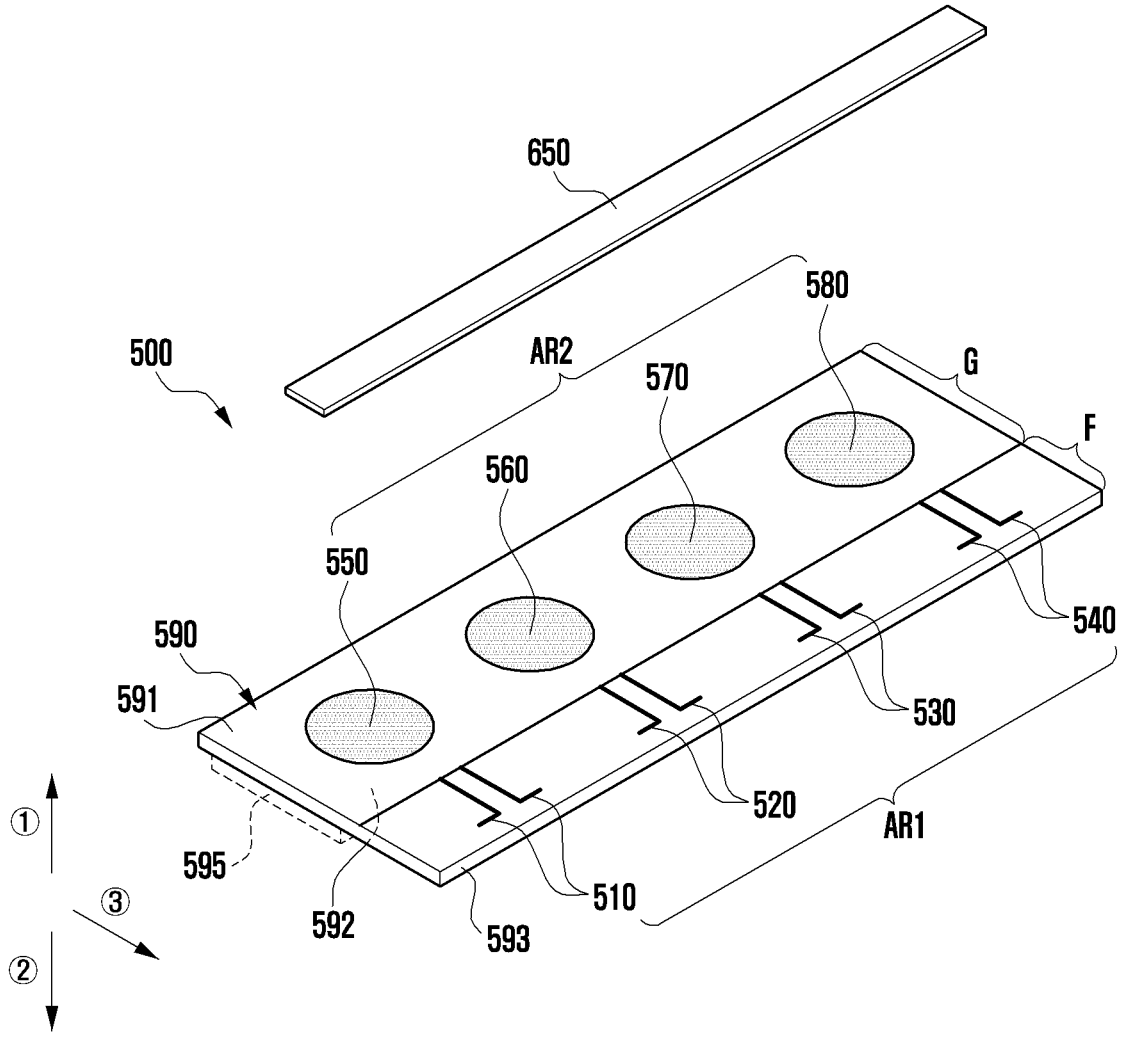
FIG. 5 is a perspective view illustrating an antenna structure according to various embodiments of the disclosure.

FIG. 5 is a perspective view illustrating an antenna structure 500 according to an embodiment of the disclosure.

An antenna module including the antenna structure 500 and a wireless communication circuit 595, shown in FIG. 5, may be similar, at least in part, to the third antenna module 246 of FIG. 2, or may include other embodiments of the antenna module.

Referring to FIG. 5, the antenna structure 500 may include a printed circuit board (PCB) 590, a first antenna array AR1 disposed in the PCB 590, and a second antenna array AR2 disposed near the first antenna array AR1. According to an embodiment of the disclosure, the PCB 590 may have a first board surface 591 facing a first direction (denoted by ①), a second board surface 592 facing a second direction (denoted by ②) opposite to the first direction, and a lateral board surface 593 surrounding an inner space between the first and second board surfaces 591 and 592. According to an embodiment of the disclosure, the first antenna array AR1 may include a plurality of conductive patterns 510, 520, 530, and 540, as a first antenna elements, disposed at regular intervals in the inner space between the first and second board surfaces 591 and 592 of the PCB 590. According to an embodiment of the disclosure, the first antenna array AR1 may be disposed in a fill-and-cut region F that contains a dielectric layer of the PCB 590. According to an embodiment of the disclosure, the second antenna array AR2 may include a plurality of conductive patches 550, 560, 570, and 580, as a second antenna elements, exposed on the first board surface 591 of the PCB 590 or disposed near the first board surface 591 in the inner space between the first and second board surfaces 591 and 592.

According to an embodiment of the disclosure, the second antenna array AR2 may be disposed in a ground region G that contains a ground layer of the PCB 590. According to an embodiment of the disclosure, the plurality of conductive patterns 510, 520, 530, and 540 may operate as a dipole antenna or a monopole antenna. According to an embodiment of the disclosure, the plurality of conductive patches 550, 560, 570, and 580 may operate as a patch antenna. In another embodiment of the disclosure, the first antenna array AR1 may include a plurality of conductive patch antennas having polarization characteristics. In another embodiment of the disclosure, the first antenna array AR1 may include a conductive patch antenna having polarization characteristics and a dipole antenna disposed therebetween.

According to various embodiments of the disclosure, the antenna structure 500 may further include the wireless communication circuit 595 that is mounted on the second board surface 592 of the PCB 590 and electrically connected to the first and second antenna arrays AR1 and AR2. For example, the antenna structure 500 including the wireless communication circuit 595 may be similar to the third antenna module 246 of FIG. 4A. In another embodiment of the disclosure, the wireless communication circuit 595 may be disposed in the inner space of the electronic device (e.g., the electronic device 300 in FIG. 3A) to be spaced apart from the antenna structure 500, and electrically connected to the PCB 590 through an electrical connection member (e.g., an RF coaxial cable or a flexible PCB (FPCB) type RF cable (FRC)).

According to various embodiments of the disclosure, the antenna structure 500 may be disposed in the inner space of the electronic device (e.g., the electronic device 600 in FIG. 6) to form a beam pattern in a third direction (denoted by ③) (e.g., a direction that the lateral board surface 593 faces) perpendicular to the first direction (denoted by ①) through the first antenna array AR1. According to an embodiment of the disclosure, the third direction may include a direction that a lateral member (e.g., the lateral member 620 in FIG. 6) of the electronic device faces. According to an embodiment of the disclosure, the antenna structure 500 may be disposed in the inner space of the electronic device to form a beam pattern in the first direction through the second antenna array AR2. According to an embodiment of the disclosure, the first direction may include a direction that a rear cover (e.g., the rear cover 640 in FIG. 6) or a front cover (e.g., the front cover 630 in FIG. 6) of the electronic device faces. According to an embodiment of the disclosure, the wireless communication circuit 595 may be configured to transmit and/or receive a radio signal in a frequency range of about 3 GHz to about 100 GHz through the first antenna array AR1 and/or the second antenna array AR2.

Although embodiments of the disclosure describe the antenna structure 500 that includes the first antenna array AR1 including four conductive patterns 510, 520, 530, and 540 and the second antenna array AR2 including four conductive patches 550, 560, 570, and 580, this is only and is not construed as a limitation. For example, the antenna structure 500 may include, as the first antenna array AR1, one conductive pattern or two, three, five, or more conductive patterns, and may include, as the second antenna array AR2, one conductive patch or two, three, five, or more conductive patches.

According to various embodiments of the disclosure, the electronic device (e.g., the electronic device 600 in FIG. 6) may include at least one conductor 650 (e.g., a reflector) disposed near the PCB 590 to improve the directivity of the first antenna array AR1. According to an embodiment of the disclosure, the conductor 650 may include a metal material. According to an embodiment of the disclosure, the conductor 650 may include, in the inner space of the electronic device, a support member (e.g., a carrier) made of a dielectric material, a metal pattern (e.g., a laser direct structuring (LDS) pattern) disposed on the front cover or the rear cover, a metal plate (e.g., a copper foil, a stainless steel, or a metal bracket), a flexible PCB (FPCB) having a metal pattern, or a conductive paint. In another embodiment of the disclosure, the conductor 650 may be implemented as at least a part of a conductive shield can disposed inside (e.g., on the PCB) the electronic device to shield noise of an electrical element, or as at least a part of a decorative member (e.g., a camera deco) disposed on the outside (e.g., the outer surface) of the electronic device. According to an embodiment of the disclosure, the conductor 650 (e.g., a conductive pattern or a radio wave inducing member) may be disposed between the first and second antenna arrays AR1 and AR2 in the inner space of the electronic device, when the first board surface 591 is viewed from above, thus improving the directivity of a beam pattern of the first antenna array AR1.

Figure 6:
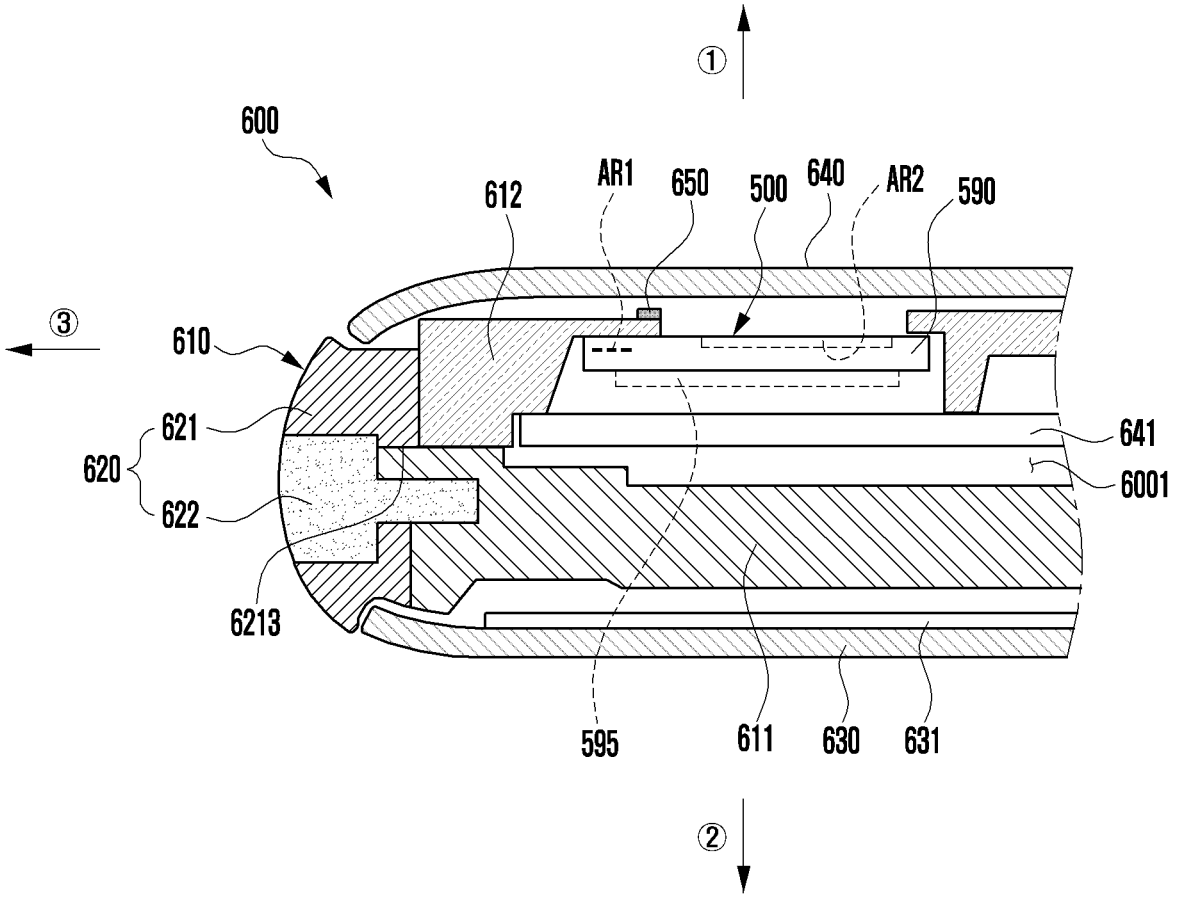
FIG. 6 is a cross-sectional view partially illustrating an electronic device including an antenna structure disposed therein according to an embodiment of the disclosure.

FIG. 6 is a cross-sectional view partially illustrating an electronic device 600 including an antenna structure 500 disposed therein according to an embodiment of the disclosure.

The electronic device 600 shown in FIG. 6 may be similar, at least in part, to the electronic device 101 of FIG. 1 or the electronic device 300 of FIG. 3A, or may include other embodiments of the electronic device.

Referring to FIG. 6, the electronic device 600 (e.g., the electronic device 300 in FIG. 3A) may include a housing 610 that includes a front cover 630 (e.g., a first cover or a first plate) facing a second direction (denoted by ②) (e.g., the Z-axis direction in FIG. 3A), a rear cover 640 (e.g., a second cover or a second plate) facing a first direction (denoted by ①) (e.g., the negative Z-axis direction in FIG. 3B) opposite to the front cover 630, and a lateral member 620 surrounding an inner space 6001 between the front cover 630 and the rear cover 640. According to an embodiment of the disclosure, the lateral member 620 may include a conductive portion 621 disposed at least in part and a polymer portion 622 (e.g., a non-conductive portion), for example, insert-injected into the conductive portion 621. In another embodiment of the disclosure, the polymer portion 622 may be replaced with a space or any other dielectric material. In another embodiment of the disclosure, the polymer portion 622 may be structurally combined with the conductive portion 621.

According to various embodiments of the disclosure, the conductive portion 621 may be formed as a unit conductive portion interposed between non-conductive portions (e.g., segmented portions) spaced apart from each other, thus operating as a legacy antenna configured to transmit and/or receive a radio signal in a frequency range of about 400 MHz to about 6000 MHz by the wireless communication circuit disposed inside the electronic device.

According to an embodiment of the disclosure, the lateral member 620 may include a support member 611 (e.g., the first support member 3211 in FIG. 3C) disposed in the inner space 6001. According to an embodiment of the disclosure, the support member 611 may be extended from the lateral member 620 into the inner space 6001 or formed by a structural coupling with the lateral member 620. According to an embodiment of the disclosure, the support member 611 may be extended from the conductive portion 621. According to an embodiment of the disclosure, the support member 611 may be extended from the conductive portion 621.

According to an embodiment of the disclosure, the support member 611 may include a polymer member and/or a conductive member. According to an embodiment of the disclosure, the support member 611 may support at least in part a device substrate 641 (e.g., a main substrate) and/or a display 631 disposed in the inner space 6001. In another embodiment of the disclosure, the support member 611 may support at least in part a battery (e.g., the battery 350 in FIG. 3C) and/or the device substrate 641 disposed in the inner space 6001. According to an embodiment of the disclosure, the display 631 may be disposed in the inner space 6001 to be visible from the outside through at least a portion of the front cover 630.

According to various embodiments of the disclosure, the first board surface 591 of the PCB 590 of the antenna structure 500 may be disposed to face the front cover 640 in the inner space 6001 of the electronic device 600. For example, the antenna structure 500 may be supported through at least one antenna support member 612 (e.g., a dielectric structure) disposed in the inner space 6001 of the electronic device 600. According to an embodiment of the disclosure, the at least one antenna support member 612 may include a polymer material. According to an embodiment of the disclosure, a plurality of conductive patterns (e.g., the plurality of conductive patterns 510, 520, 530, and 540 in FIG. 5) of the first antenna array AR1 may be disposed in the PCB 590 to form a beam pattern in the third direction (denoted by ③) facing the lateral member 620 and being perpendicular to the first direction (denoted by ①). According to an embodiment of the disclosure, a plurality of conductive patches (e.g., the plurality of conductive patches 550, 560, 570, and 580 in FIG. 5) of the second antenna array AR2 may be disposed in the PCB 590 to form a beam pattern in the first direction facing the rear cover 640.

According to various embodiments of the disclosure, at least a part of the conductive portion 621 of the electronic device 600 may be disposed at a position overlapped with the third direction in which the beam pattern of the first antenna array AR1 is directed. Therefore, the beam pattern formed by the first antenna array AR1 of the antenna structure 500 may be changed and/or distorted in an unintended direction other than the third direction by the conductive portion 621.

The electronic device 600 according to embodiments of the disclosure may include the conductor 650 disposed, when the rear cover 640 is viewed from above, between the first antenna array AR1 and the second antenna array AR2 in the inner space 6001 of the electronic device 600. According to an embodiment of the disclosure, the conductor 650 may include a reflector formed of a metal member. According to an embodiment of the disclosure, the conductor 650 may be disposed to be supported by the at least one antenna support member 612. According to an embodiment of the disclosure, the conductor 650 made of a metal material may include an LDS metal pattern formed on the antenna support member 612 formed of a dielectric material, or include a metal plate, a conductive tape, or an FPCB attached to the antenna support member 612. According to an embodiment of the disclosure, when the lateral member 620 is viewed from the outside (e.g., in the third direction), the conductor 650 may be disposed closer to one surface (e.g., the rear cover 640) (i.e., at a higher position in FIG. 6) than the first antenna array AR1 and the second antenna array AR2. In an embodiment of the disclosure, the one surface may be a surface that the beam pattern of the second antenna array AR2 faces. For example, if the beam pattern of the second antenna array AR2 faces the front cover 630, the one surface may be the front cover 630.

According to various embodiments of the disclosure, among the beam patterns radiated from the first antenna array AR1, the beam pattern radiated in the first direction may be reflected in the third direction through the conductor 650. This may help to improve the beam pattern directivity of the first antenna array AR1. In addition, this improvement in the beam pattern directivity may contribute to the improvement of the antenna performance regardless of the arrangement of the conductive lateral member 620.

Figure 7:
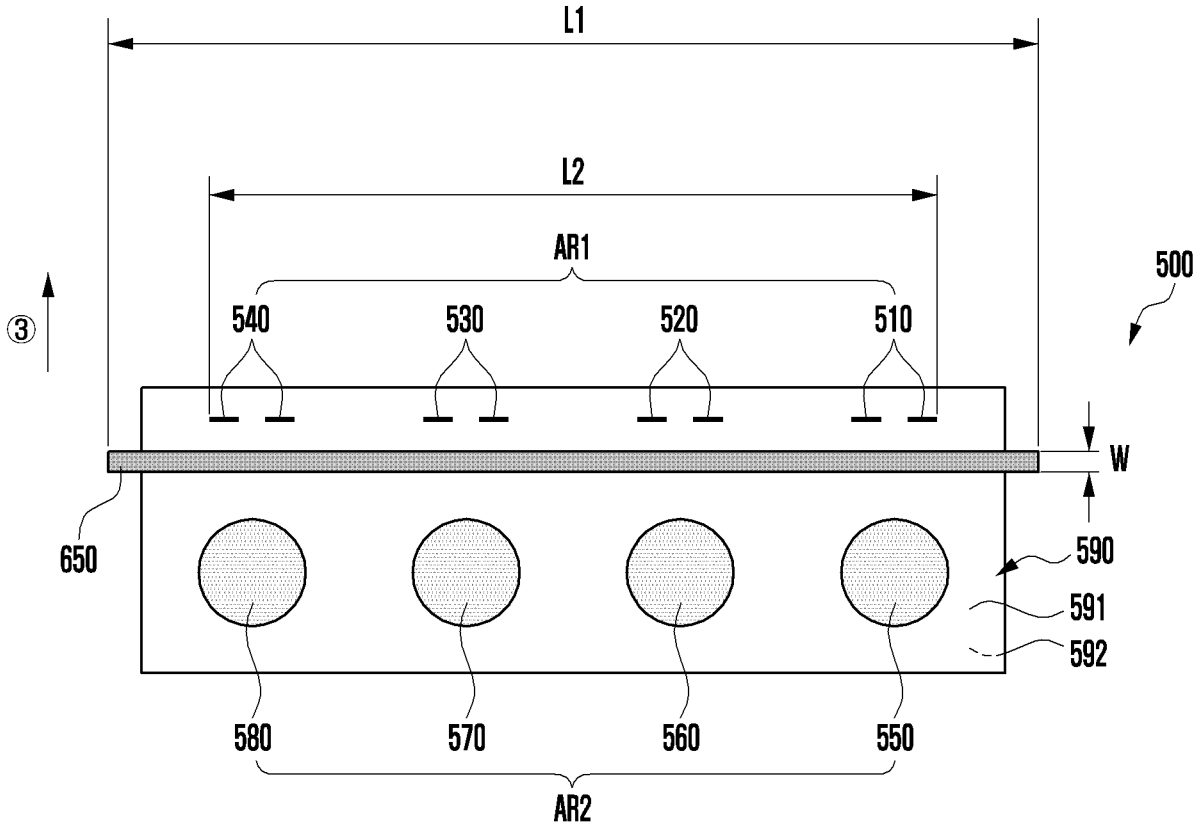
FIG. 7 is a diagram illustrating a disposed position of a conductor on a PCB according to an embodiment of the disclosure.

FIG. 7 is a diagram illustrating a disposed position of a conductor 650 on the PCB 590 according to an embodiment of the disclosure.

Referring to FIG. 7, when the first board surface 591 is viewed from above, the conductor 650 may be disposed between the first antenna array AR1, including the plurality of conductive patterns 510, 520, 530, and 540 as the first plurality of antenna elements, and the second antenna array AR2 including the plurality of conductive patches 550, 560, 570, and 580 as the plurality of second antenna elements. According to an embodiment of the disclosure, the conductor 650 may be disposed to have a certain length L1 in a direction parallel with the arrangement direction of the plurality of conductive patterns 510, 520, 530, and 540. According to an embodiment of the disclosure, the length L1 of the conductor 650 may be greater than the arrangement length L2 of the plurality of conductive patterns 510, 520, 530, and 540. According to an embodiment of the disclosure, the conductor 650 may be formed to have a certain width W in a direction perpendicular to the length direction of the conductor 650. For example, the width W1 of the conductor 650 may be determined as a dimension that does not affect the radiation performance of the second antenna array AR2.

Figure 8A:
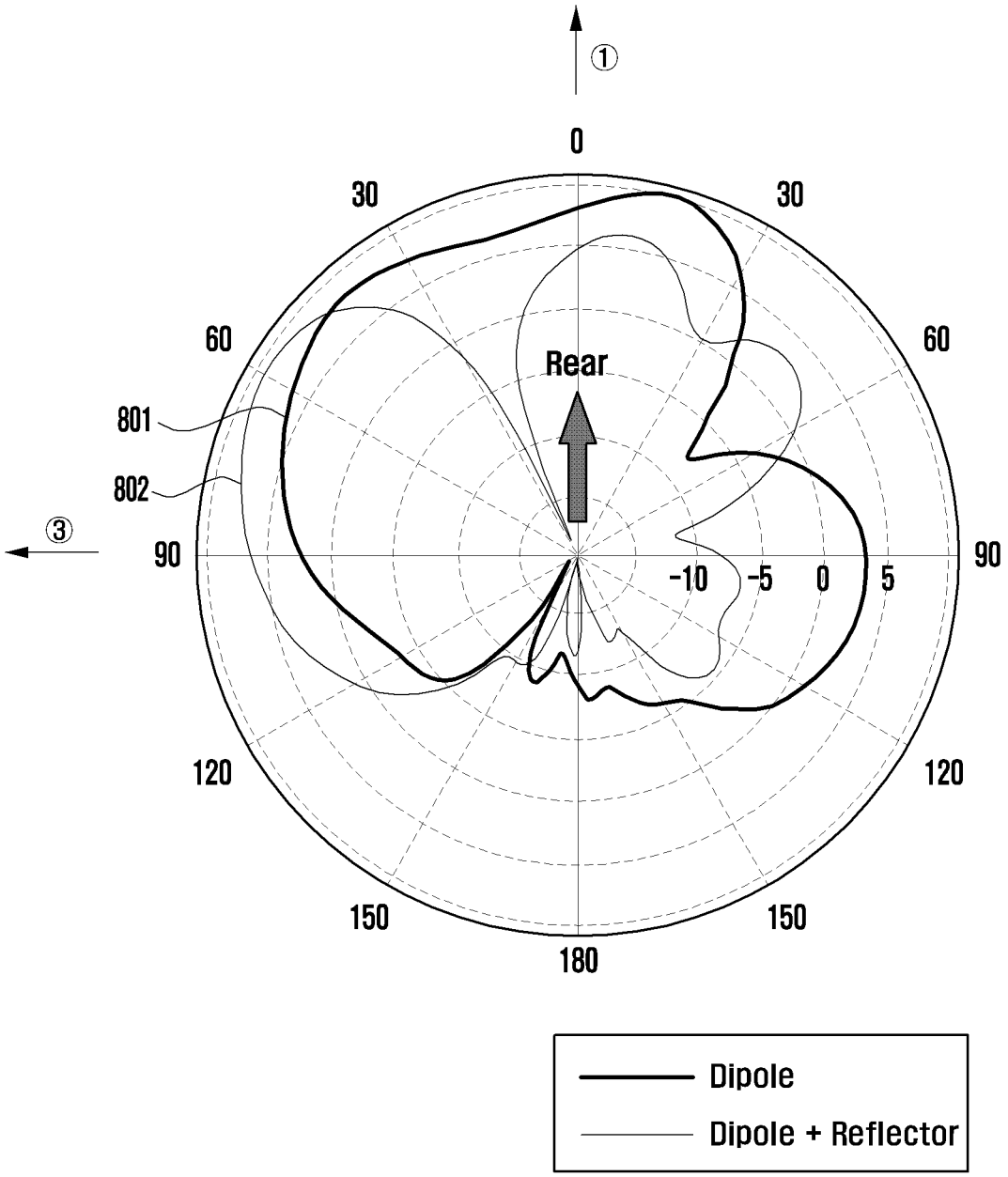
FIG. 8A is a view comparing radiation patterns of an antenna structure depending on a presence or absence of a conductor according to an embodiment of the disclosure.

FIG. 8A is a view comparing radiation patterns of an antenna structure depending on the presence or absence of the conductor 650 according to an embodiment of the disclosure.

Referring to FIG. 8A, compared to a radiation beam pattern 801 of the antenna structure 500 without the conductor 650, a radiation beam pattern 802 of the antenna structure 500 with the conductor 650 has improved directivity in the direction (denoted by ③) of the lateral member 620.

Figure 8B:
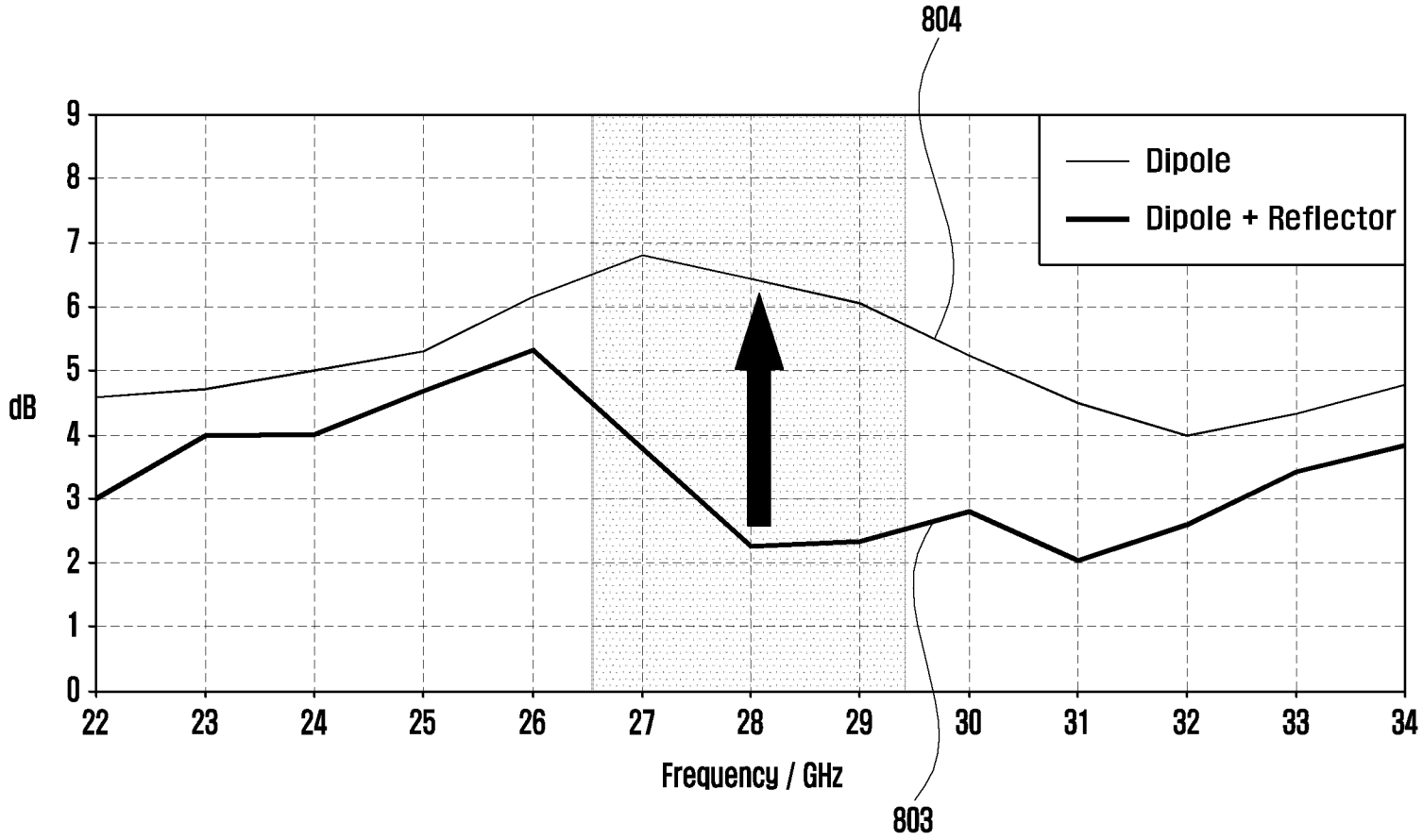
FIG. 8B is a view comparing gain characteristics of an antenna structure depending on a presence or absence of a conductor according to an embodiment of the disclosure.

FIG. 8B is a view comparing gain characteristics of an antenna structure depending on a presence or absence of a conductor 650 according to an embodiment of the disclosure.

Referring to FIG. 8B, at an operating frequency of about 28 GHz, a gain 804 of the antenna structure 500 with the conductor 650 is improved by about 4 dB in comparison with a gain 803 of the antenna structure 500 without the conductor 650. In addition, in a frequency band ranging from about 26.5 GHz to about 29.5 GHz, the gain 804 of the antenna structure 500 with the conductor 650 is improved by about 2 dB to about 4 dB in comparison with the gain 803 of the antenna structure 500 without the conductor 650.

Figure 9:
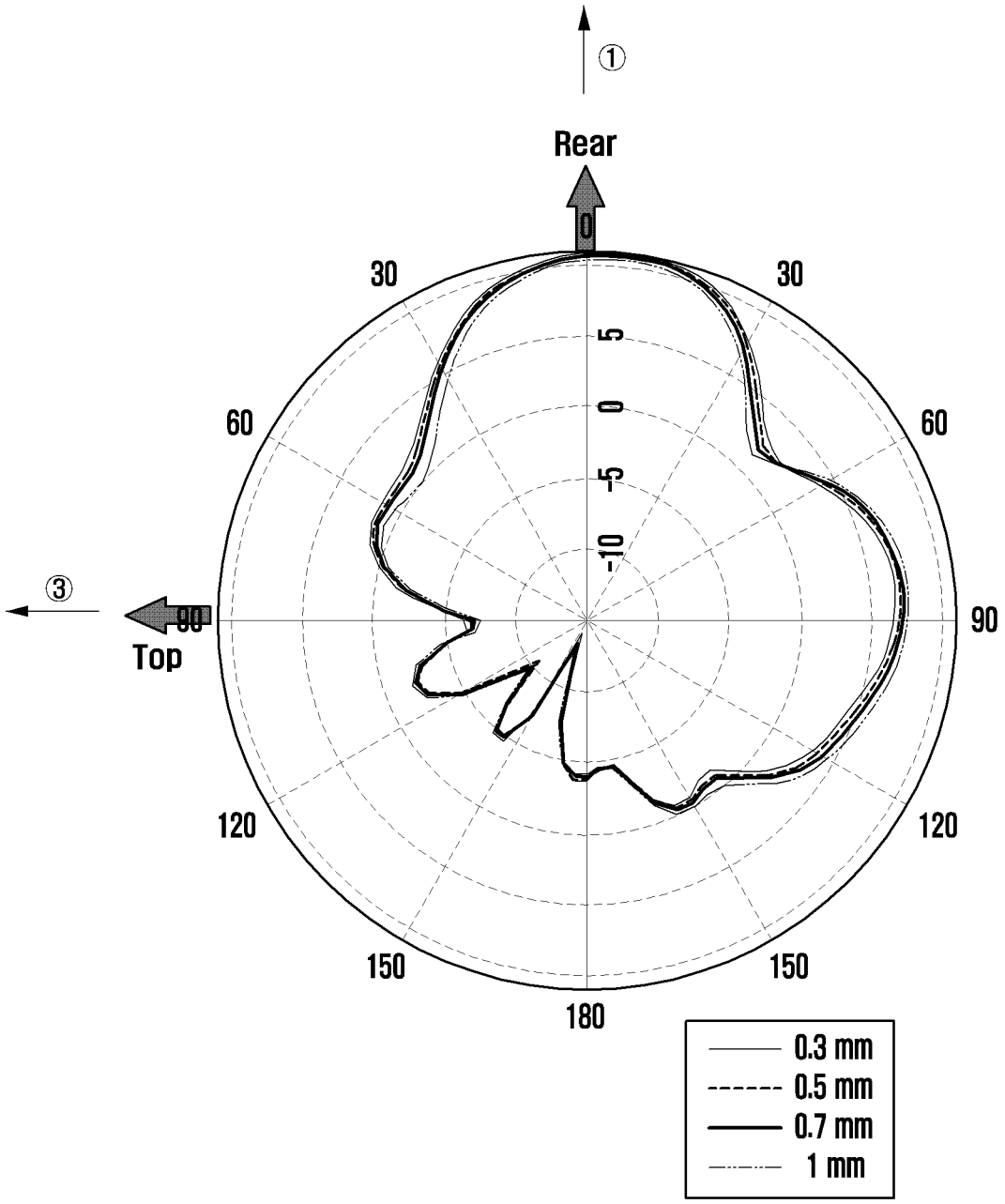
FIG. 9 is a diagram illustrating radiation patterns of a second antenna array depending on a change in a width of a conductor according to an embodiment of the disclosure.

FIG. 9 is a diagram illustrating radiation patterns of a second antenna array AR2 depending on a change in a width W of a conductor 650 according to an embodiment of the disclosure.

Referring to FIG. 9, when the radiation performance of the second antenna array AR2 is measured while changing the width of the conductor 650 to 0.3 mm, 0.5 mm, 0.7 mm, and 1.0 mm, it can be seen that the second antenna array AR2 has almost no change in the directivity and/or gain in the first direction (denoted by ①). This means that even if the width W of the conductor 650 slightly changes, the radiation performance of the second antenna array AR2 is not affected.

FIGS. 10A, 10B, 10C, 10D, 10E, 10F, 10G, and 10H are diagrams illustrating layouts of an antenna structure 500 including a conductor according to various embodiments of the disclosure.

According to various embodiments of the disclosure, the conductor 651, 652, 653, 654, 655, 656, or 657 may be formed in various shapes, based on two conditions of a layout. One is that when viewed from a rear cover (e.g., the rear cover 640 in FIG. 6), the conductor is disposed between the first and second antenna arrays AR1 and AR2. The other is that when viewed from a lateral member (e.g., the lateral member 620 in FIG. 6), the conductor is disposed closer to one surface (e.g., the front cover 630 or the rear cover 640 in FIG. 6), toward which a beam pattern of the second antenna array AR2 is directed, than the first antenna array AR1 and the second antenna array AR2 are.

Figure 10A:
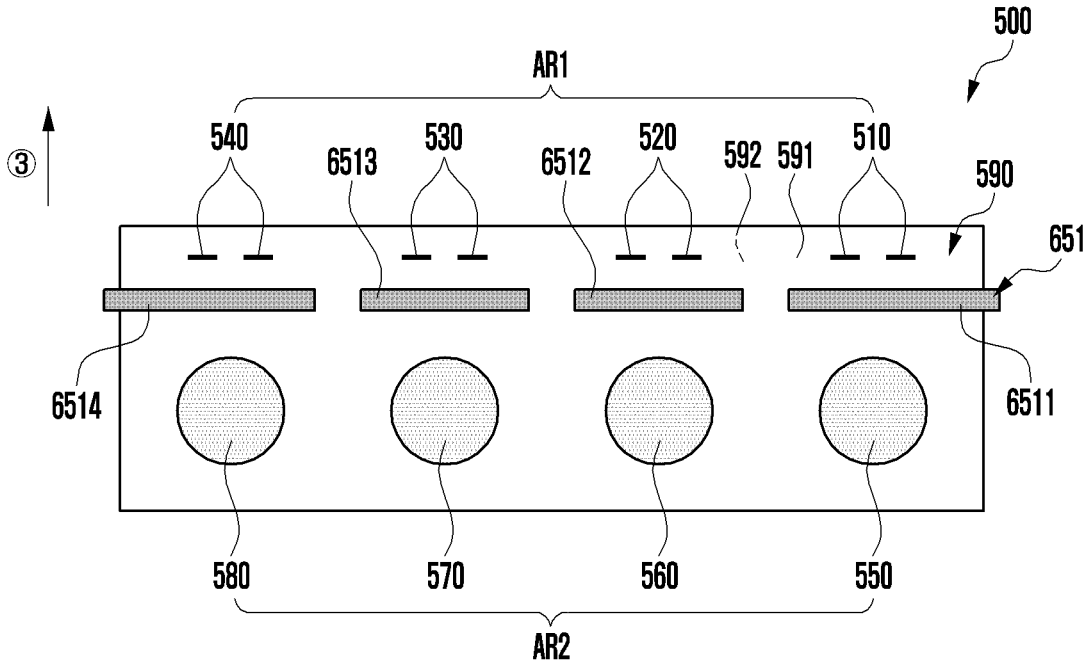
FIGS. 10A, 10B, 10C, 10D, 10E, 10F, 10G, and 10H are diagrams illustrating layouts of an antenna structure including a conductor according to various embodiments of the disclosure.

Referring to FIG. 10A, the conductor 651 may be including a plurality of portions 6511, 6512, 6513, and 6514 arranged at regular intervals. According to an embodiment of the disclosure, the plurality of portions 6511, 6512, 6513, and 6514 of the conductor 651 may be formed in a number corresponding to that of the plurality of conductive patterns 510, 520, 530, and 540 of the first antenna array AR1. For example, the conductor 651 may include a first portion 6511 disposed at a position facing the first conductive pattern 510, a second portion 6512 spaced apart from the first portion 6511 and disposed at a position corresponding to the second conductive pattern 520, a third portion 6513 spaced apart from the second portion 6512 and disposed at a position corresponding to the third conductive pattern 530, and a fourth portion 6514 spaced apart from the third portion 6513 and disposed at a position corresponding to the fourth conductive pattern 540. According to an embodiment of the disclosure, the plurality of conductive patches 550, 560, 570, and 580 of the second antenna array AR2 may be formed in a number equal to or different from the number of the plurality of portions 6511, 6512, 6513, and 6514 of the conductor 651 (or the number of the plurality of conductive patterns 510, 520, 530, and 540 of the first antenna array AR1). According to an embodiment of the disclosure, the conductor 651 that is divided into the plurality of portions 6511, 6512, 6513, and 6514 arranged at regular intervals may improve the directivity of the first antenna array AR1 and/or prevent the radiation performance of the second antenna array AR2 from being degraded.

Figure 10B:
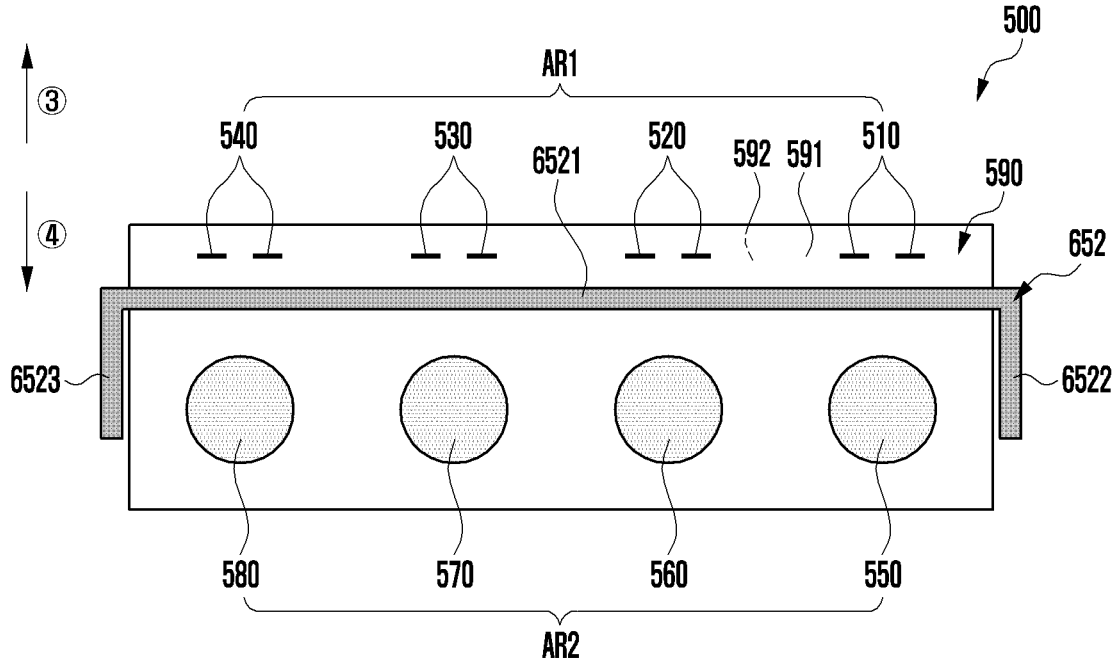

Referring to FIG. 10B, when the PCB 590 is viewed from above, the conductor 652 may include an overlapped portion 6521, which is overlapped with the PCB 590, and a first extended portion 6522 and/or a second extended portion 6523, both of which are extended respectively from both ends of the overlapped portion 6521 in a fourth direction (denoted by ④). According to an embodiment of the disclosure, the overlapped portion 6521 may be formed to have a length corresponding to the PCB 590. In another embodiment of the disclosure, the length of the overlapped portion 6521 may be greater than the arrangement length of the first antenna array AR1. According to an embodiment of the disclosure, the first and second extended portions 6522 and 6523 may be extended in a direction (e.g., the fourth direction) perpendicular to the overlapped portion 6521 from both ends of the overlapped portion 6521, respectively. In another embodiment of the disclosure, the first and second extended portions 6522 and 6523 may be extended from both ends of the overlapped portion 6521 while being inclined inward or outward by a certain angle with respect to the fourth direction.

Figure 10C:
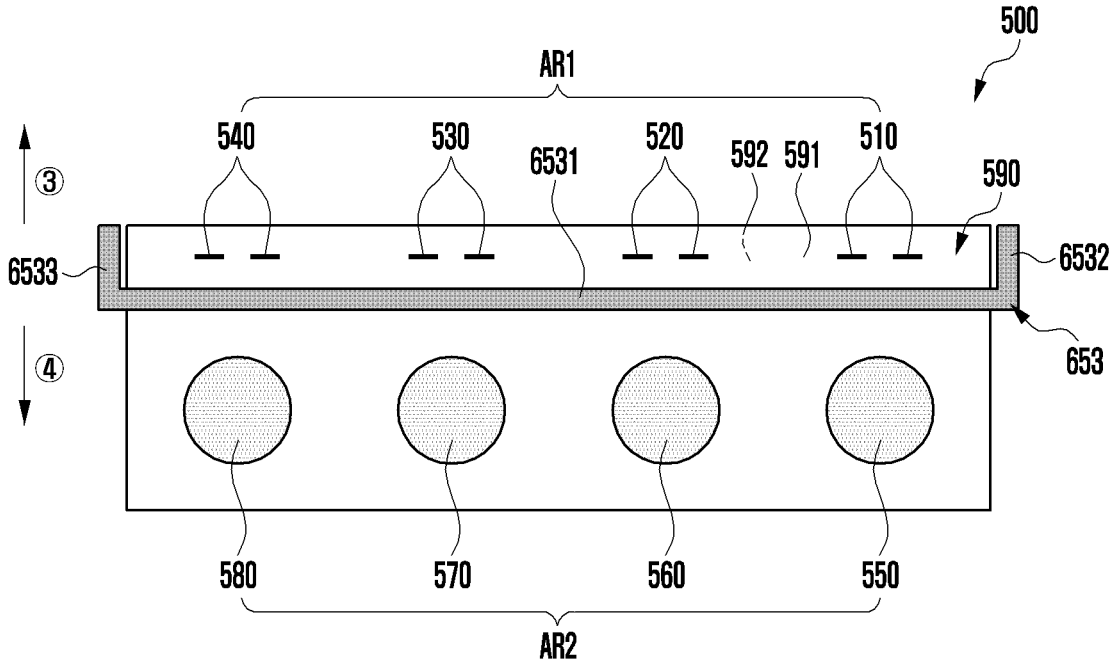

Referring to FIG. 10C, when the PCB 590 is viewed from above, the conductor 653 may include an overlapped portion 6531, which is overlapped with the PCB 590, and a first extended portion 6532 and/or a second extended portion 6533, both of which are extended respectively from both ends of the overlapped portion 6531 in a third direction (denoted by ③) (i.e., toward the first antenna array AR1). According to an embodiment of the disclosure, the first and second extended portions 6532 and 6533 may be extended in a direction (e.g., the third direction) perpendicular to the overlapped portion 6531 from both ends of the overlapped portion 6531, respectively. In another embodiment of the disclosure, the first and second extended portions 6532 and 6533 may be extended from both ends of the overlapped portion 6531 while being inclined inward or outward by a certain angle with respect to the third direction.

Figure 10D:
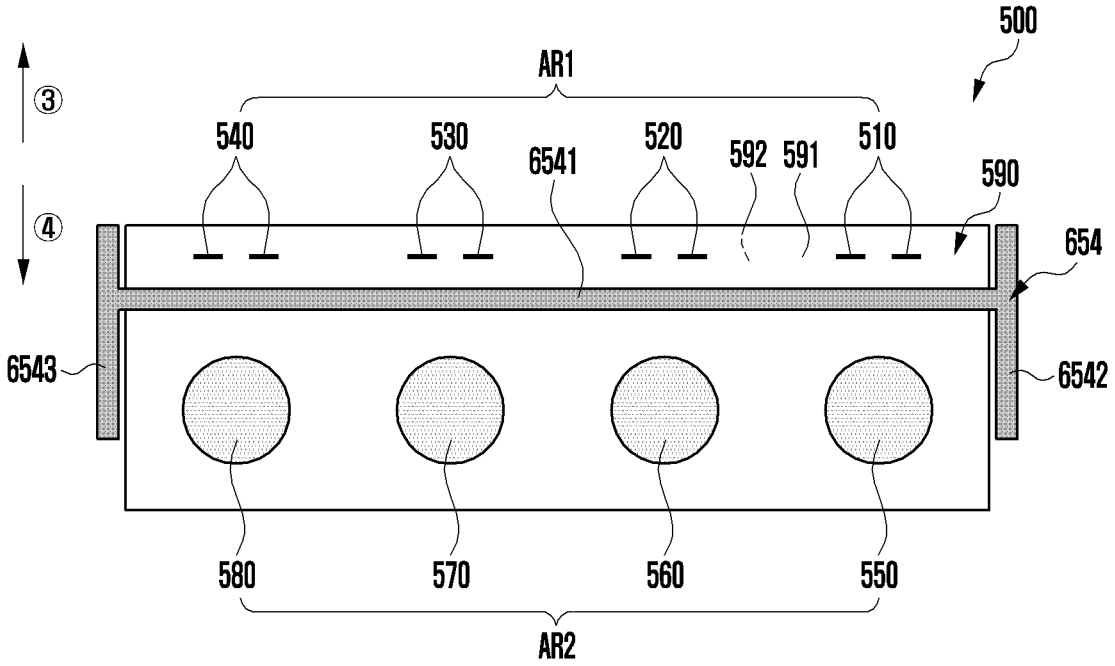

Referring to FIG. 10D, when the PCB 590 is viewed from above, the conductor 654 may include an overlapped portion 6541, which is overlapped with the PCB 590, and a first extended portion 6542 and/or a second extended portion 6543, each of which is extended from a corresponding end of the overlapped portion 6541 in both the third direction (denoted by ③) and the fourth direction (denoted by ④). According to an embodiment of the disclosure, each of the first and second extended portions 6542 and 6543 may be extended in a direction (e.g., both of the third and fourth directions) perpendicular to the overlapped portion 6541 from one end of the overlapped portion 6541. In another embodiment of the disclosure, each of the first and second extended portions 6542 and 6543 may be extended from one end of the overlapped portion 6541 while being inclined inward or outward by a certain angle with respect to the third and fourth directions.

Figure 10E:
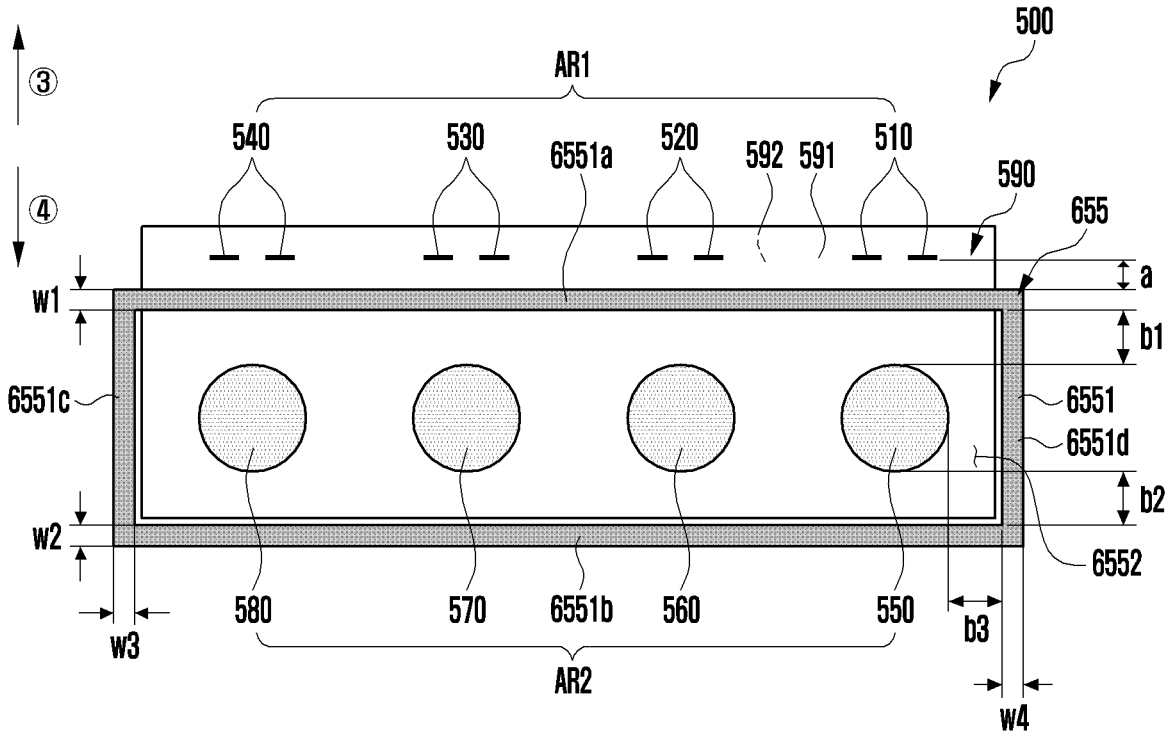

Referring to FIG. 10E, when the PCB 590 is viewed from above, the conductor 655 may be formed of a conductive portion 6551 that resembles a closed loop surrounding the second antenna array AR2 and creating a closed-loop space 6552. In another embodiment of the disclosure, the conductive portion 6551 may be including a plurality of segments arranged at regular (or irregular) intervals as shown in FIG. 10A and having a rectangular cluster shape that surrounds the second antenna array AR2 as a whole. According to an embodiment of the disclosure, the conductor 655 that is disposed to allow the plurality of conductive patches 550, 560, 570, and 580 of the second antenna array AR2 to be contained in the closed-loop space 6552 when the PCB 590 is viewed from above may improve the directivity of the first antenna array AR1 and also operate as a radio wave lens for the second antenna array AR2.

According to various embodiments of the disclosure, the conductive portion 6551 may be disposed to have a first vertical distance (a) from the conductive patterns 510, 520, 530, and 540 of the first antenna array AR1 when the PCB 590 is viewed from above. According to an embodiment of the disclosure, the first vertical distance (a) may be at least 0.5 mm. For example, the first vertical distance (a) may range from 0.5 mm to 1 mm According to an embodiment of the disclosure, the conductive portion 6551 may be disposed to have second vertical distances (b1, b2, and b3) from the adjacent conductive patches 550, 560, 570, and 580 of the second antenna array AR2 when the PCB 590 is viewed from above. According to an embodiment of the disclosure, each of the second vertical distances (b1, b2, and b3) may be at least 1 mm. For example, each of the second vertical distances (b1, b2, and b3) may range from 1 mm to 2 mm. The second vertical distances (b1, b2, and b3) may be equal to or different from each other.

According to various embodiments of the disclosure, the conductive portion 6551 may be formed to have different widths for respective parts thereof. For example, the conductive portion 6551 may be including a first part 6551*a* disposed adjacent to the first antenna array AR1 and having a first width (w1), a second part 6551*b* spaced apart from and parallel with the first part 6551*a* and having a second width (w2), a third part 6551*c* connecting one end of the first part 6551*a* and one end of the second part 6551*b* and having a third width (w3), and a fourth part 6551*d* connecting the other end of the first part 6551*a* and the other end of the second part 6551*b* and having a fourth width (w4). According to an embodiment of the disclosure, the first width (w1) may be determined based on the first vertical distance (a) and the second vertical distance (b1). According to an embodiment of the disclosure, the second width (w2), the third width (w3), and/or the fourth width (w4) may be equal to the first width (w1). In another embodiment of the disclosure, the second width (w2), the third width (w3), and/or the fourth width (w4) may be greater or smaller than the first width (w1). In another embodiment of the disclosure, the first width (w1), the second width (w2), the third width (w3), and/or the fourth width (w4) may be different from each other.

Figure 10F:
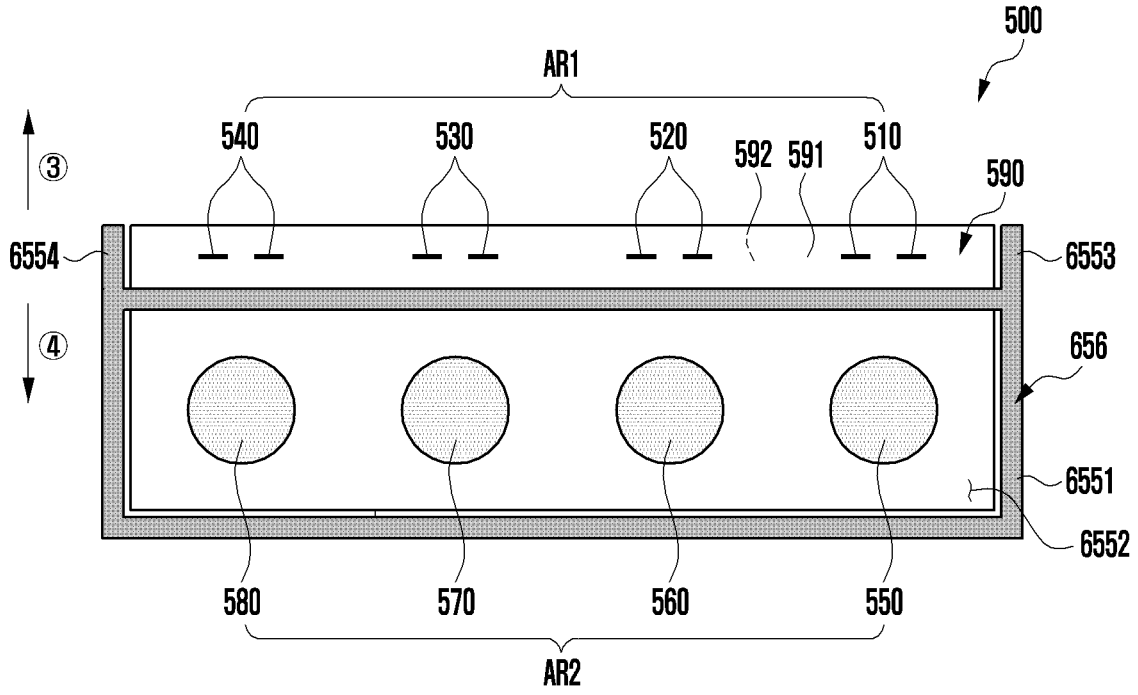

Referring to FIG. 10F, when the PCB 590 is viewed from above, the conductor 656 may include the conductive portion 6551 surrounding the second antenna array AR2 and creating the closed-loop space 6552, and a first extended portion 6553 and/or a second extended portion 6554, both of which are extended respectively from both ends of the conductive portion 6551 in the third direction (denoted by ③). According to an embodiment of the disclosure, the conductor 656 that surrounds the plurality of conductive patches 550, 560, 570, and 580 of the second antenna array AR2 when the PCB 590 is viewed from above may operate as a radio wave lens for the second antenna array AR2. According to an embodiment of the disclosure, the conductor 656 may improve the directivity of the first antenna array AR1 through a part of the conductive portion 6551 and the first and/or second extended portion(s) 6553 and/or 6554.

Figure 10G:
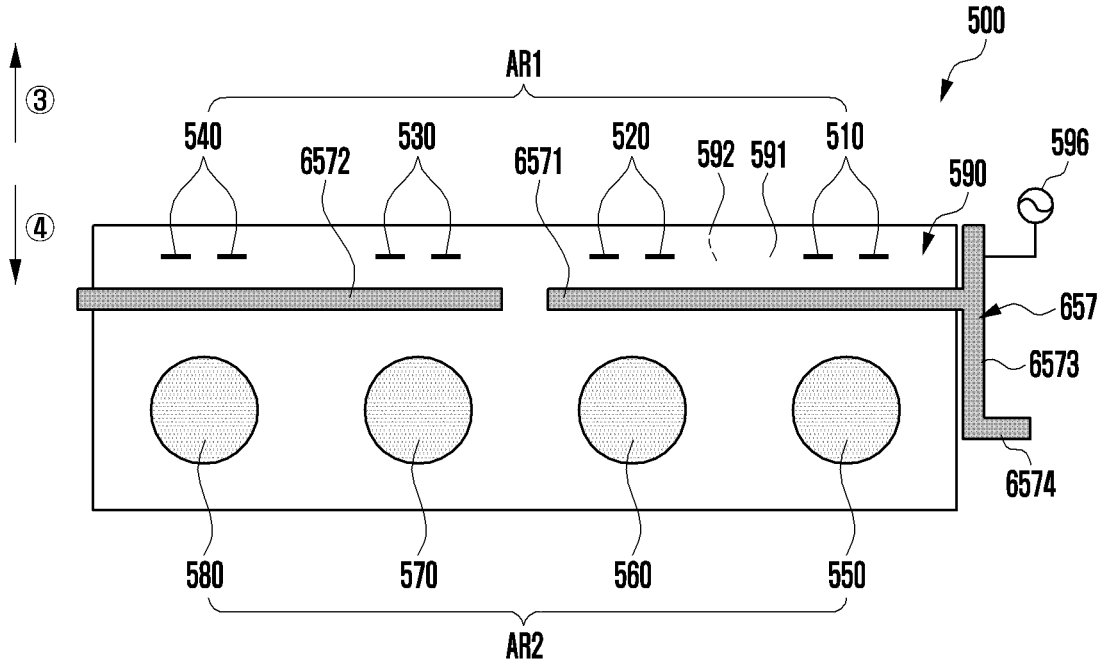

Referring to FIG. 10G, when the PCB 590 is viewed from above, the conductor 657 may include at least two divided portions 6571 and 6572 overlapped with the PCB 590, and a first extended portion 6573 extended from one divided portion 6571. According to an embodiment of the disclosure, the conductor 657 may include a first portion 6571 and a second portion 6572 disposed spaced apart from the first portion 6571. According to an embodiment of the disclosure, the conductor 657 may further include the first extended portion 6573 extended from one end of the first portion 6571 in both the third direction (denoted by ③) and the fourth direction (denoted by ④). According to an embodiment of the disclosure, the conductor 657 may also include a second extended portion 6574 extended from the first extended portion 6573 outward (e.g., in a direction perpendicular to the fourth direction). In another embodiment of the disclosure, the second extended portion 6574 may be extended from the first extended portion 6573 in various directions and/or in various lengths. According to an embodiment of the disclosure, the first portion 6571, the first extended portion 6573, and/or the second extended portion 6574 may operate as a legacy antenna or a 5G sub-6 antenna by being electrically connected to a wireless communication circuit 596 (e.g., the wireless communication module 192 in FIG. 1) disposed inside an electronic device (e.g., the electronic device 101 in FIG. 1). In another embodiment of the disclosure, the second portion 6572 may operate as a legacy antenna or a 5G sub-6 antenna by being electrically connected to the wireless communication circuit 596. In another embodiment of the disclosure, the first portion 6571, the second portion 6572, the first extended portion 6573, and/or the second extended portion 6574 may operate as a legacy antenna or a 5G sub-6 antenna by being electrically connected to the wireless communication circuit 596. According to an embodiment of the disclosure, the wireless communication circuit 596 may be configured to transmit and/or receive a radio signal in a frequency band ranging from about 400 MHz to about 3000 MHz through the first portion 6571, the first extended portion 6573, and/or the second extended portion 6574. According to an embodiment of the disclosure, the operating frequency band may be determined depending on the extended lengths, directions, and/or shapes of the first and second extended portions 6573 and 6574 extended from the first portion 6571 of the conductor 657.

Figure 10H:
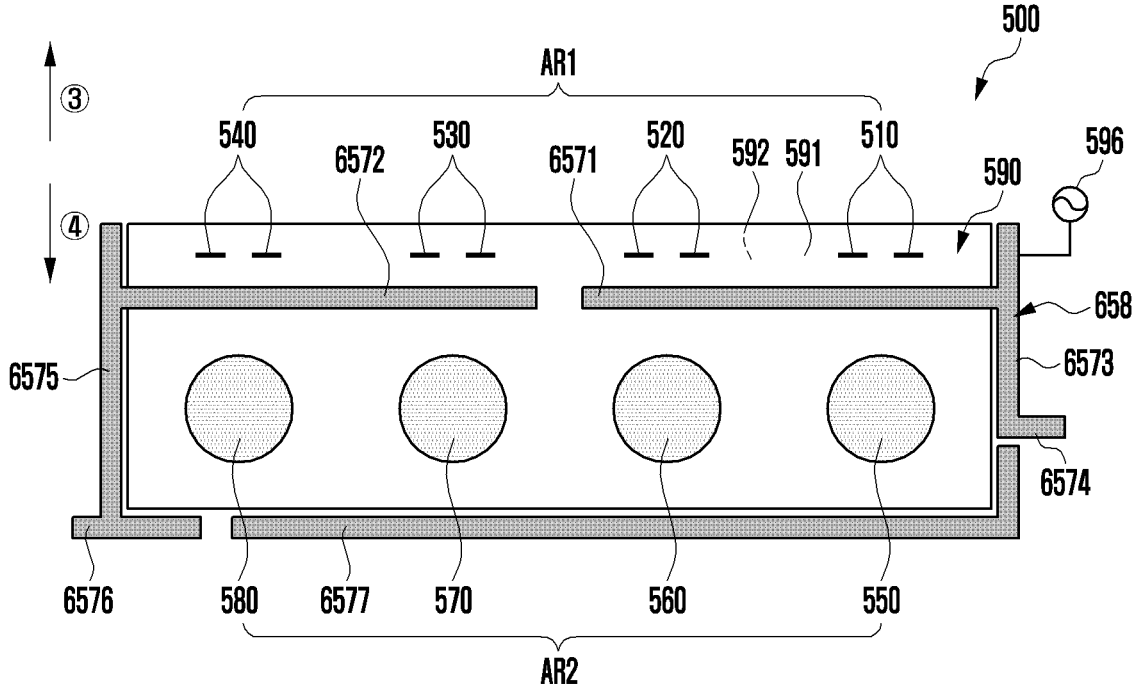

Referring to FIG. 10H, when the PCB 590 is viewed from above, the conductor 658 may include a first portion 6571, a second portion 6572, and a third portion 6577, which are spaced apart from each other and overlapped at least partially with the PCB 590. According to an embodiment of the disclosure, the first portion 6571, the second portion 6572, and the third portion 6577 may be arranged in a rectangular cluster shape to substantially surround the second antenna array AR2 when the PCB 590 is viewed from above.

According to various embodiments of the disclosure, the conductor 658 may further include a first extended portion 6573 extended from one end of the first portion 6571 in both the third direction (denoted by ③) and the fourth direction (denoted by ④). According to an embodiment of the disclosure, the conductor 658 may also include a second extended portion 6574 extended from the first extended portion 6573 outward (e.g., in a direction perpendicular to the fourth direction). According to an embodiment of the disclosure, the first portion 6571, the first extended portion 6573, and/or the second extended portion 6574 may operate as an antenna, e.g., a legacy antenna or a 5G sub-6 antenna, by being electrically connected to a wireless communication circuit 596 (e.g., the wireless communication module 192 in FIG. 1) disposed inside an electronic device (e.g., the electronic device 101 in FIG. 1).

According to various embodiments of the disclosure, the conductor 658 may further include a third extended portion 6575 extended from one end of the second portion 6572 in both the third direction and the fourth direction. According to an embodiment of the disclosure, the conductor 658 may also include a fourth extended portion 6576 extended from the third extended portion 6575 outward (e.g., in a direction perpendicular to the fourth direction). According to an embodiment of the disclosure, the second portion 6572, the third extended portion 6575, and/or the fourth extended portion 6576 may operate as an antenna, e.g., a legacy antenna or a 5G sub-6 antenna, by being electrically connected to the wireless communication circuit 596. In another embodiment of the disclosure, the third portion 6577 may operate as an antenna, e.g., a legacy antenna or a 5G sub-6 antenna, by being electrically connected to the wireless communication circuit 596.

Figure 11A:
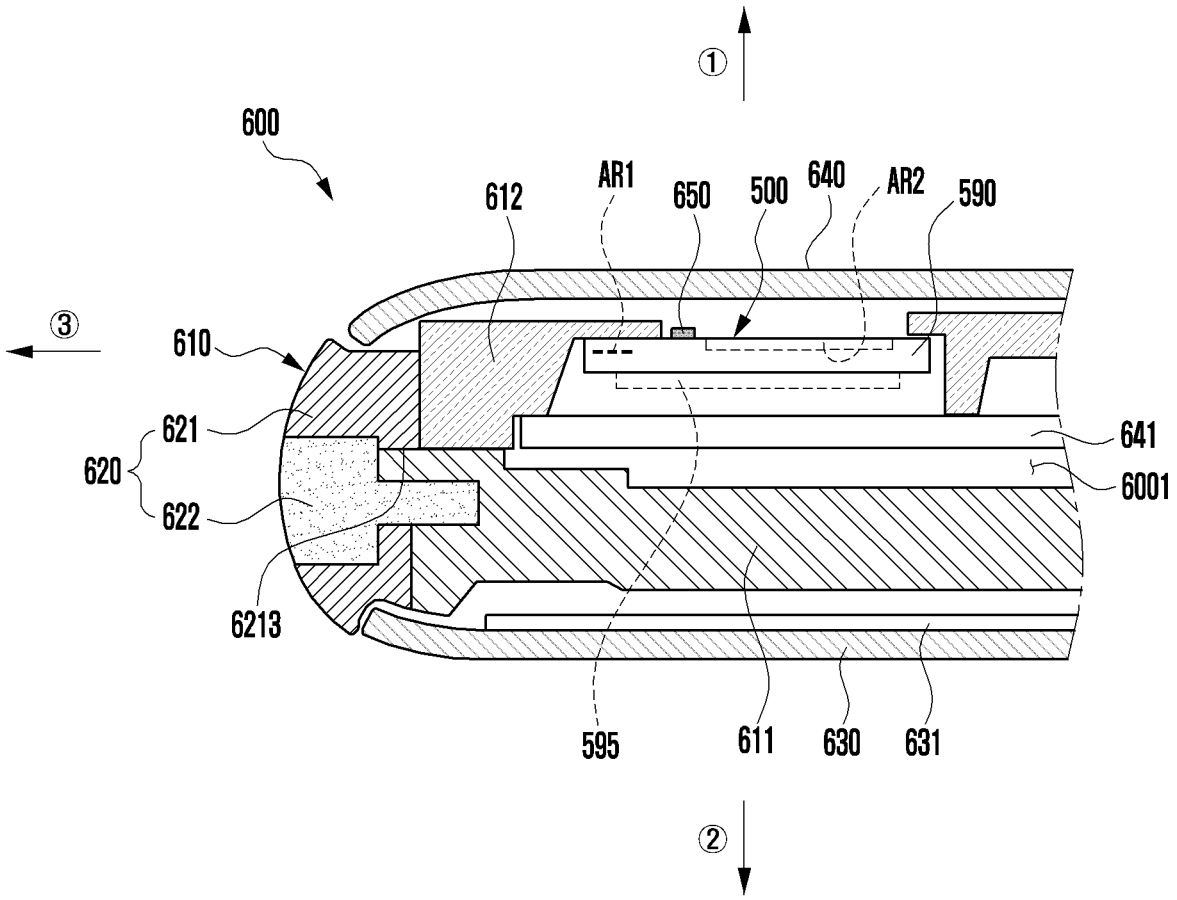
FIGS. 11A and 11B are cross-sectional views partially illustrating an electronic device including a conductor according to various embodiments of the disclosure.
Figure 11B:
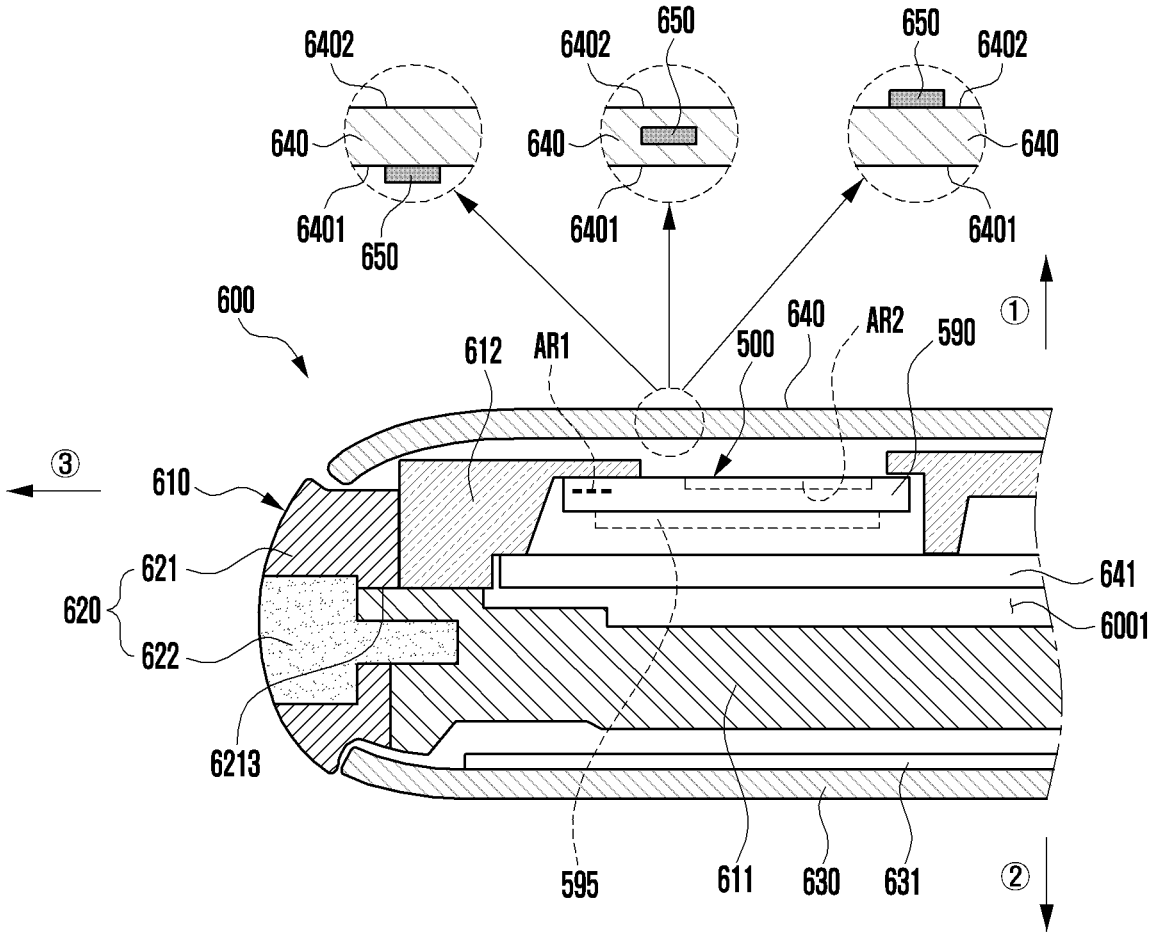

FIGS. 11A and 11B are cross-sectional views partially illustrating an electronic device 600 including a conductor 650 according to various embodiments of the disclosure.

Except for the arrangement of the conductor 650, the remaining configurations illustrated in FIGS. 11A and 11B are substantially the same as those illustrated in FIG. 6, and thus detailed descriptions thereof may be omitted.

Referring to FIG. 11A, the conductor 650 may be disposed on an upper surface of the PCB 590. In this case, the conductor 650 may include a conductive pattern formed on the upper surface of the PCB 590, or a conductive thin plate sheet or FPCB attached to the upper surface of the PCB 590.

Referring to FIG. 11B, the conductor 650 may be disposed on or in the rear cover 640. According to an embodiment of the disclosure, the conductor 650 may be disposed on an inner surface 6401 of the rear cover 640. In this case, the conductor 650 may include a metal sheet, FPCB, or conductive tape attached to the inner surface 6401 of the rear cover 640. According to an embodiment of the disclosure, the conductor 650 may be embedded in the rear cover 640. For example, the conductor 650 may be embedded through an injection process (e.g., insert injection or double injection) into the rear cover 640 made of a polymer material. According to an embodiment of the disclosure, the conductor 650 may be disposed on an outer surface 6402 of the rear cover 640. In this case, the conductor 650 may include a conductive decoration member disposed on the outer surface of the electronic device 600.

Figure 12:
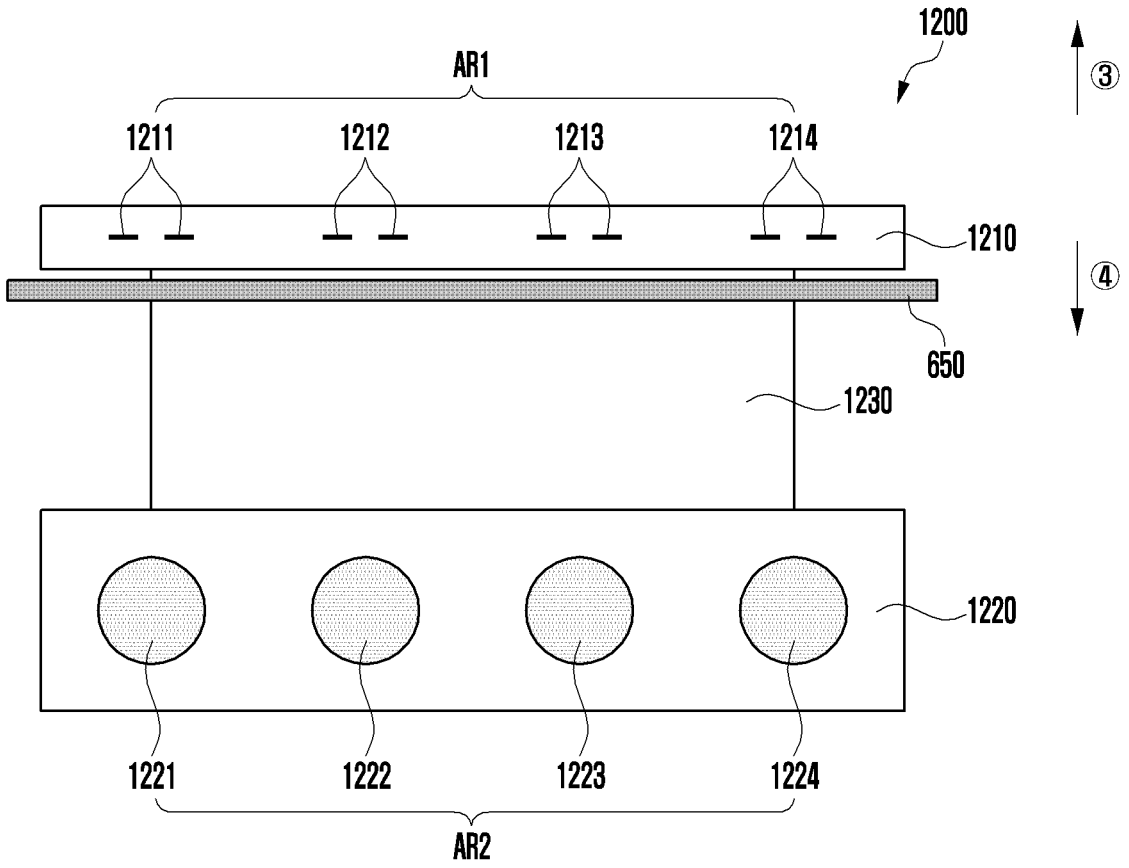
FIG. 12 is a diagram illustrating an antenna structure including a conductor according to an embodiment of the disclosure.

FIG. 12 is a diagram illustrating an antenna structure 1200 including a conductor 650 according to an embodiment of the disclosure.

The antenna structure 1200 shown in FIG. 12 may be similar, at least in part, to the third antenna module 246 of FIG. 2, or may further include another embodiment of the antenna module.

Referring to FIG. 12, the antenna structure 1200 may include a first PCB 1210 and a first antenna array AR1 including a plurality of conductive patterns 1211, 1212, 1213, and 1214, as a first plurality of antenna elements, arranged at regular intervals in the first PCB 1210. In addition, the antenna structure 1200 may further include a second PCB 1220 disposed at a position spaced apart from the first PCB 1210, a second antenna array AR2 including a plurality of conductive patches 1221, 1222, 1223, and 1224, as a second plurality of antenna elements, arranged at regular intervals in the second PCB 1220, and/or an electrical connection member 1230 electrically connecting the first and second PCBs 1210 and 1220. In another embodiment of the disclosure, the first antenna array AR1 may include a plurality of conductive patches. In another embodiment of the disclosure, the first antenna array AR1 may include a plurality of conductive patterns and/or a plurality of conductive patches. According to an embodiment of the disclosure, the electrical connection member 1230 may include an RF coaxial cable or an FPCB-type RF cable (FRC).

According to various embodiments of the disclosure, an electronic device (e.g., the electronic device 300 in FIG. 3A) may include the conductor 650, which is disposed to be spaced part from the first antenna array AR1 in a direction (denoted by ④) opposite to a direction (denoted by ③) in which the beam pattern of the first antenna array AR1 is formed. In another embodiment of the disclosure, depending on the arrangement structure of the antenna structure 1200, the conductor 650 may be disposed between the first antenna array AR1 and the second antenna array AR2 above one surface of the connection member 1230. According to an embodiment of the disclosure, the conductor 650 may reflect at least a part of the beam pattern radiated from the first antenna array AR1, thereby improving the directivity of the beam pattern. Although not shown, a wireless communication circuit (e.g., the wireless communication circuit 595 in FIG. 5) may be further disposed on the first PCB 1210 and/or the second PCB 1220.

In another embodiment of the disclosure, the antenna structure 1200 may include only the first PCB 1210 including the first antenna array AR1, and the conductor 650 disposed near the first PCB 1210.

Figure 13:
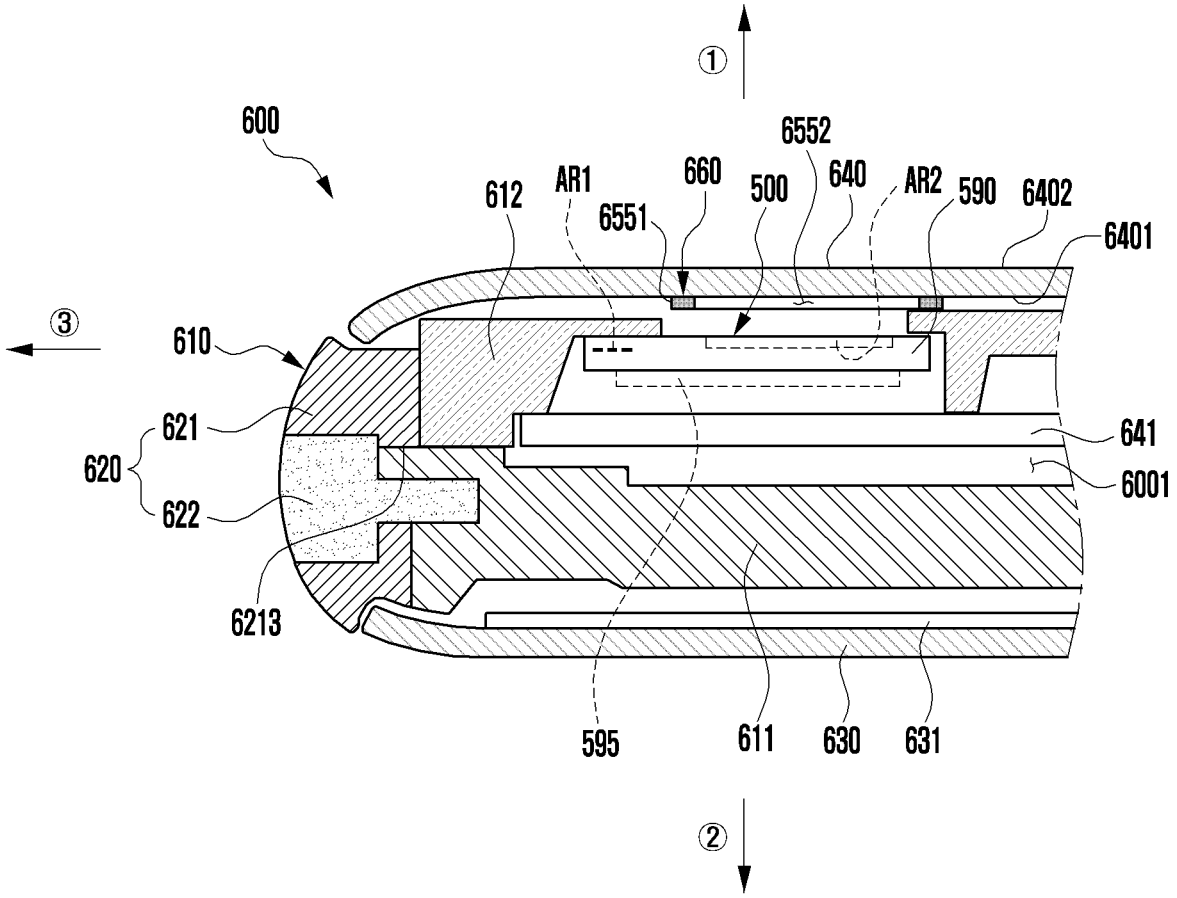
FIG. 13 is a cross-sectional view partially illustrating an electronic device including a conductor according to an embodiment of the disclosure.

FIG. 13 is a cross-sectional view partially illustrating an electronic device 600 including a conductor 660 according to various embodiments of the disclosure.

In the electronic device 600 of FIG. 13, components that are substantially the same as those of the electronic device 600 of FIG. 11A are denoted by the same reference numerals, and detailed descriptions thereof may be omitted.

Referring to FIG. 13, the electronic device 600 may include the conductor 660 that is disposed in the inner space 6001 and has a conductive portion 6551 and an opening 6552 (e.g., the closed-loop space 6552 in FIG. 10E) formed through the conductive portion 6551. According to an embodiment of the disclosure, the conductor 660 may be disposed at a position that allows the opening 6552 to be overlapped at least in part with the second antenna array AR2 when the rear cover 640 is viewed from above. For example, the opening 6552 may have a size equal to or greater than that of the second antenna array AR2.

According to various embodiments of the disclosure, the rear cover 640 may be formed of a dielectric material having a high dielectric constant (e.g., a dielectric constant of 5 or more). According to an embodiment of the disclosure, the rear cover 640 may include a ceramic material. In this case, the beam pattern radiated from the second antenna array AR2 of the antenna structure 500 may not be smoothly radiated in the first direction (denoted by ①) due to the rear cover 640 formed of a high dielectric material. This may cause the E-field to be formed in a direction parallel with the surface of the rear cover 640 (i.e., TE0 mode formation), so that the beam pattern may be dispersed and the radiation performance may be degraded.

According to various embodiments of the disclosure, because the opening 6552 is disposed to surround the second antenna array AR2 when the rear cover 640 is viewed from above, the conductor 660 may suppress the formation of the E-field in the direction parallel with the rear cover 640 and also induce the beam pattern to be formed in the first direction facing the rear cover 640 (i.e., operating as a radio wave lens). According to an embodiment of the disclosure, the conductor 660 may be disposed on the inner surface 6401 of the rear cover 640 or disposed in a recess or groove (not shown) formed on the inner surface 6401. In another embodiment of the disclosure, the conductor 660 may be disposed on the outer surface 6402 of the rear cover 640. In another embodiment of the disclosure, the conductor 660 may be replaced with a conductive pattern formed through a dielectric structure (e.g., a carrier) disposed in the inner space 6001 of the electronic device 600.

According to various embodiments of the disclosure, the conductor 660 may have substantially the same configuration as that of the conductor 655 shown in FIG. 10E. In this case, the width (e.g., the first width (w1) in FIG. 10E) of the conductive portion 6551 of the conductor 660 may be determined within a range of $$\frac{\lambda}{10\sqrt{\varepsilon_r}} \sim \frac{\lambda}{\sqrt{\varepsilon_r}}.$$

Here, λ denotes a wavelength in the operating frequency band of the antenna structure 500, and $\varepsilon_r$ denotes the dielectric constant of the rear cover 640.

Figure 14A:
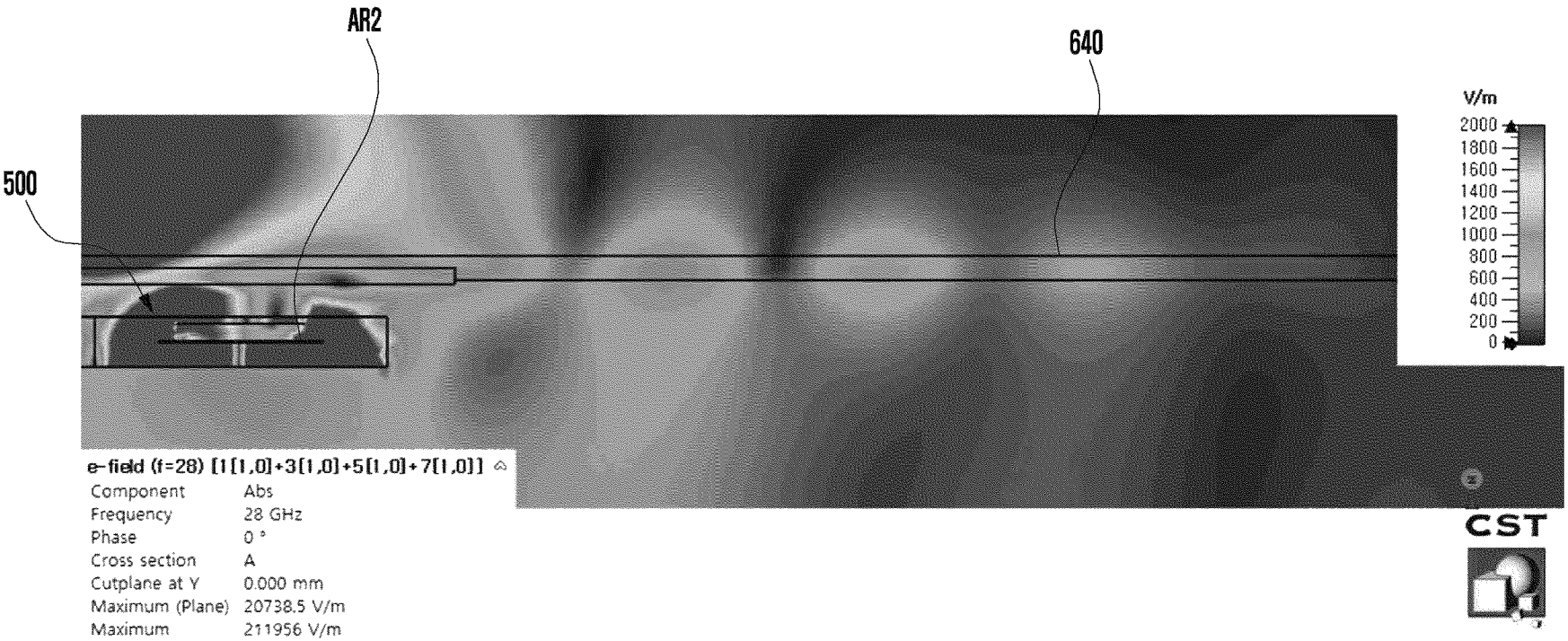
FIGS. 14A and 14B are diagrams illustrating an electric field distribution of a second antenna array through a rear cover when an electronic device of FIG. 13 does not include a conductor according to various embodiments of the disclosure.
Figure 14B:
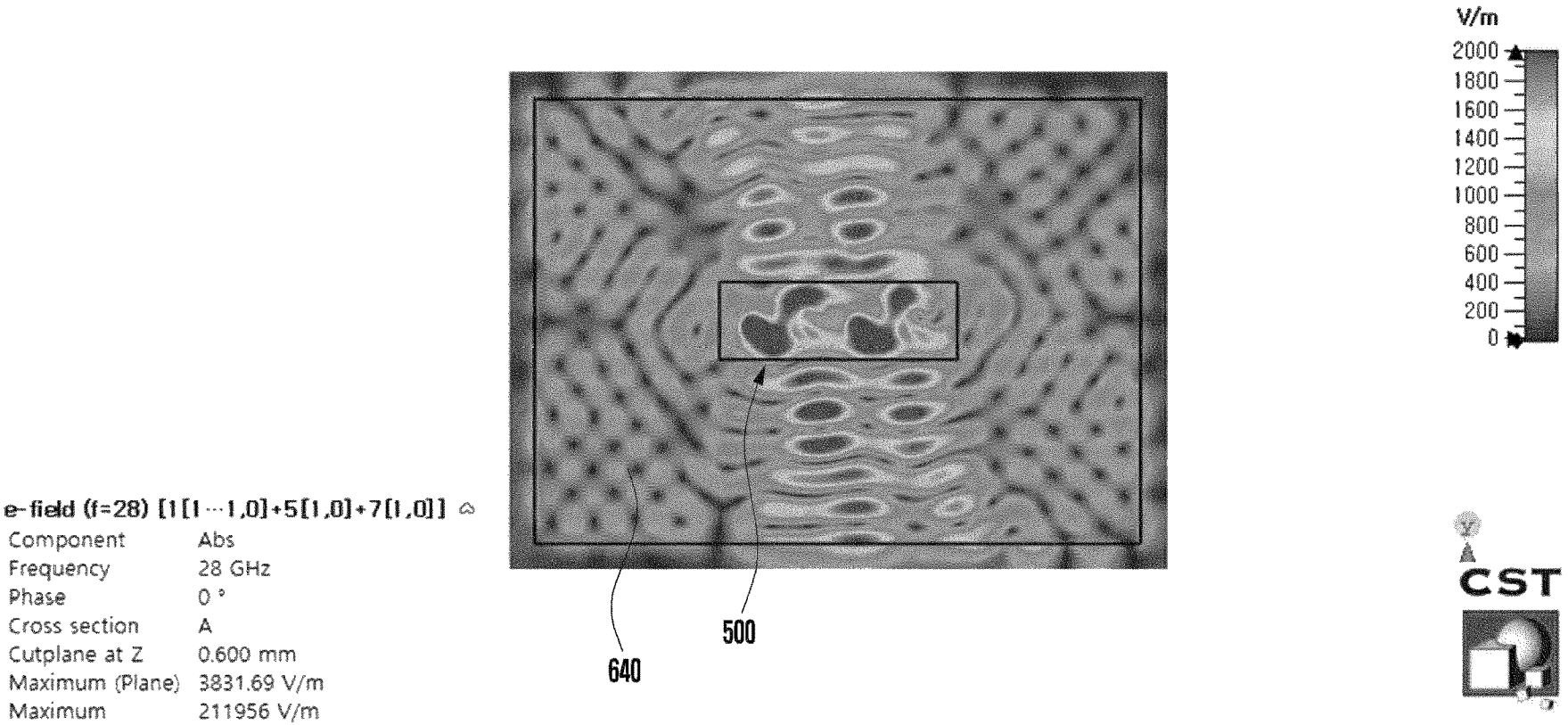

FIGS. 14A and 14B are diagrams illustrating an electric field distribution of a second antenna array through a rear cover when the electronic device of FIG. 13 does not include a conductor according to various embodiments of the disclosure.

Figure 15A:
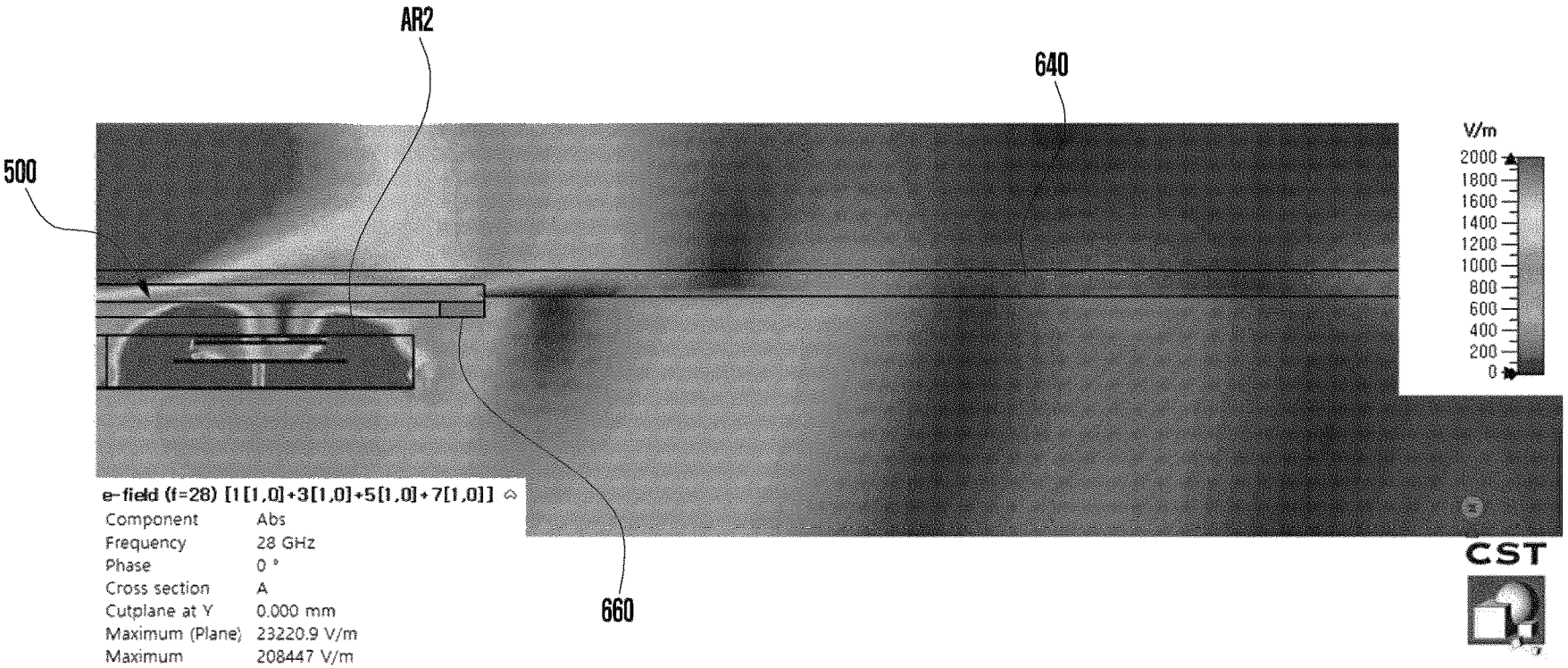
FIGS. 15A and 15B are diagrams illustrating an electric field distribution of a second antenna array through a rear cover when an electronic device of FIG. 13 includes a conductor according to various embodiments of the disclosure.
Figure 15B:
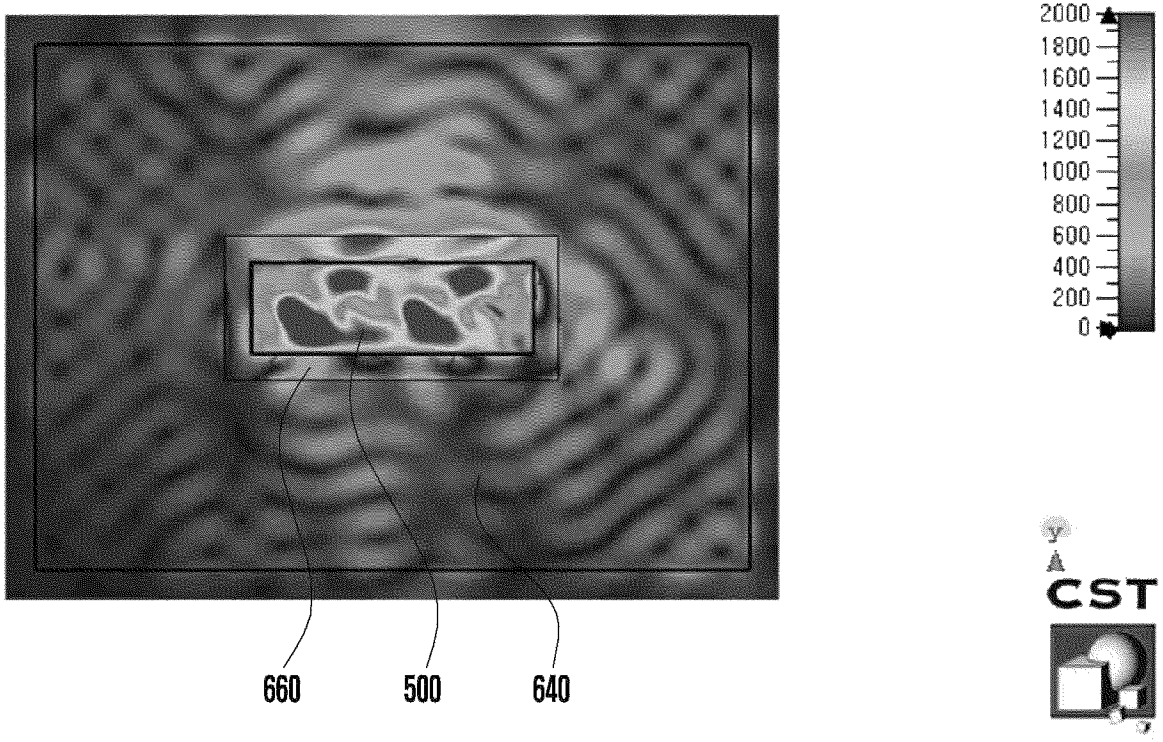

FIGS. 15A and 15B are diagrams illustrating an electric field distribution of a second antenna array through a rear cover when an electronic device of FIG. 13 includes a conductor according to various embodiments of the disclosure.

Referring to FIGS. 15A and 15B, compared to the electric field distribution on the rear cover 640 in case that the conductor 660 is not included as shown in FIGS. 14A and 14B, the electric field distribution on the rear cover 640 formed from the antenna structure 500 in case that the conductor 660 is included indicates that the E-field is significantly suppressed in a direction parallel with the rear cover 640. As a result, the beam pattern may be concentrated in the first direction (denoted by ①) facing the rear cover 640.

Figure 16A:
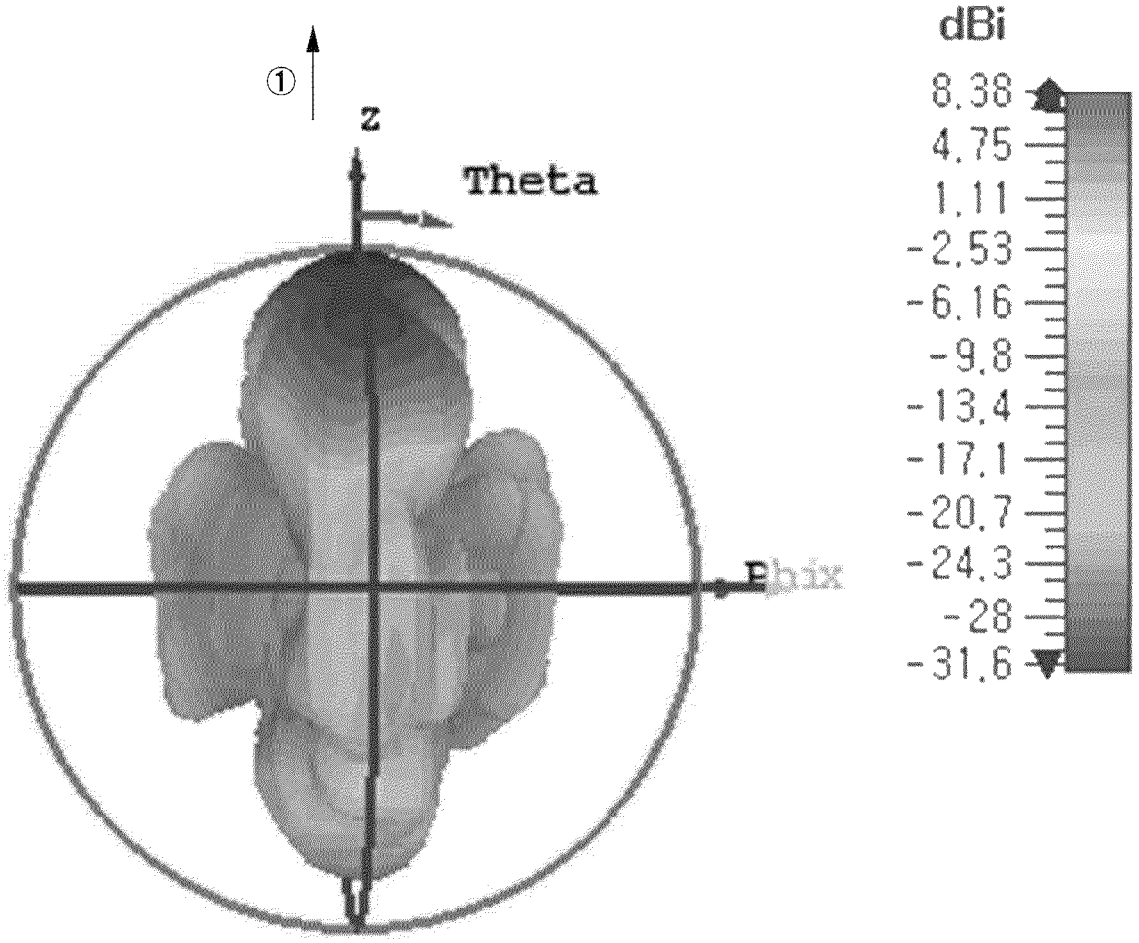
FIGS. 16A and 16B are diagrams comparing radiation patterns of a second antenna array depending on a presence or absence of a conductor in an electronic device of FIG. 13 according to various embodiments of the disclosure.
Figure 16B:
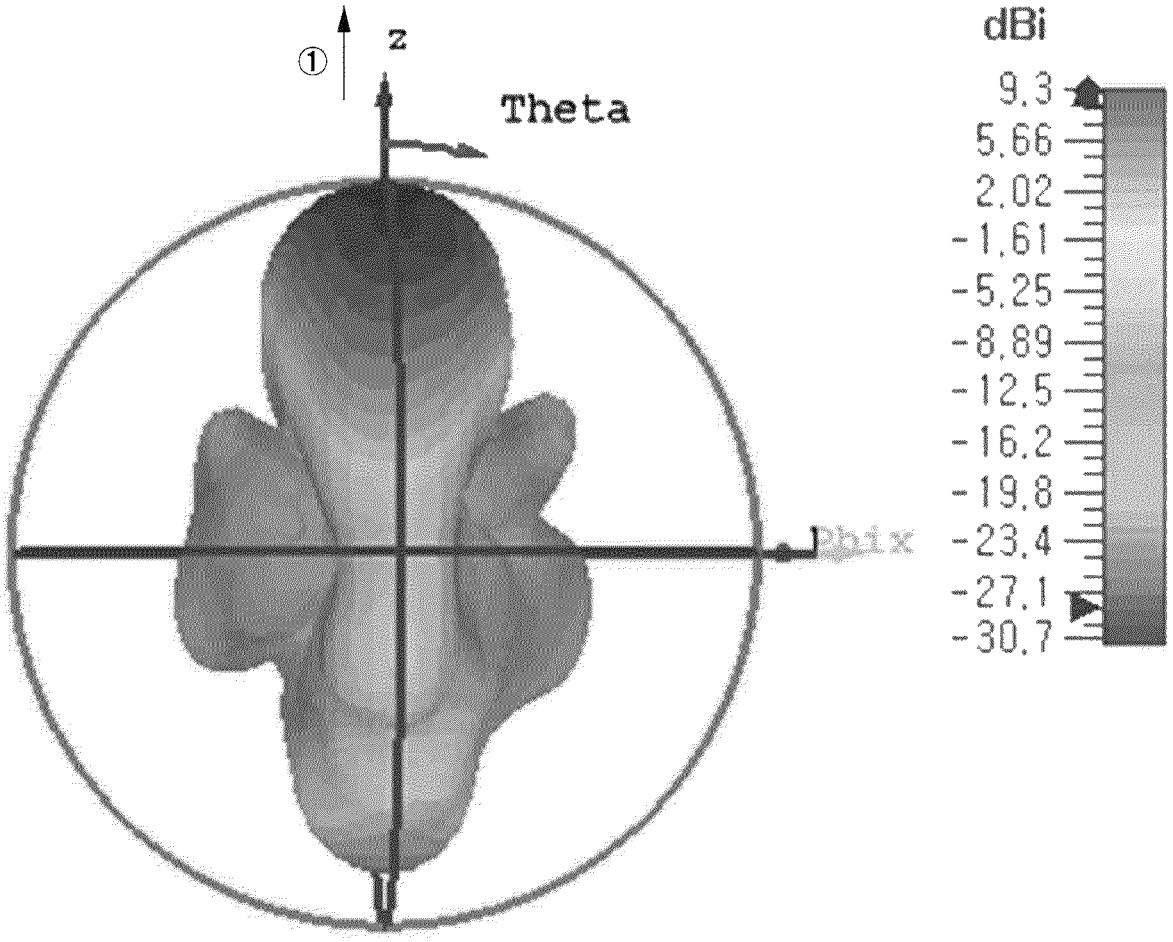

FIGS. 16A and 16B are diagrams comparing radiation patterns of a second antenna array depending on a presence or absence of a conductor in an electronic device of FIG. 13 according to various embodiments of the disclosure.

Referring to FIGS. 16A and 16B, the radiation direction of the antenna structure 500 including the conductor 660 is more concentrated in the first direction (denoted by ①) of the rear cover than the radiation direction of the antenna structure 500 including no conductor. Thus, the gain of the antenna structure 500 is improved. For example, it can be seen that the gain of the antenna structure 500 is improved in the range of about 0.5 dB to about 1.5 dB.

Figure 17A:
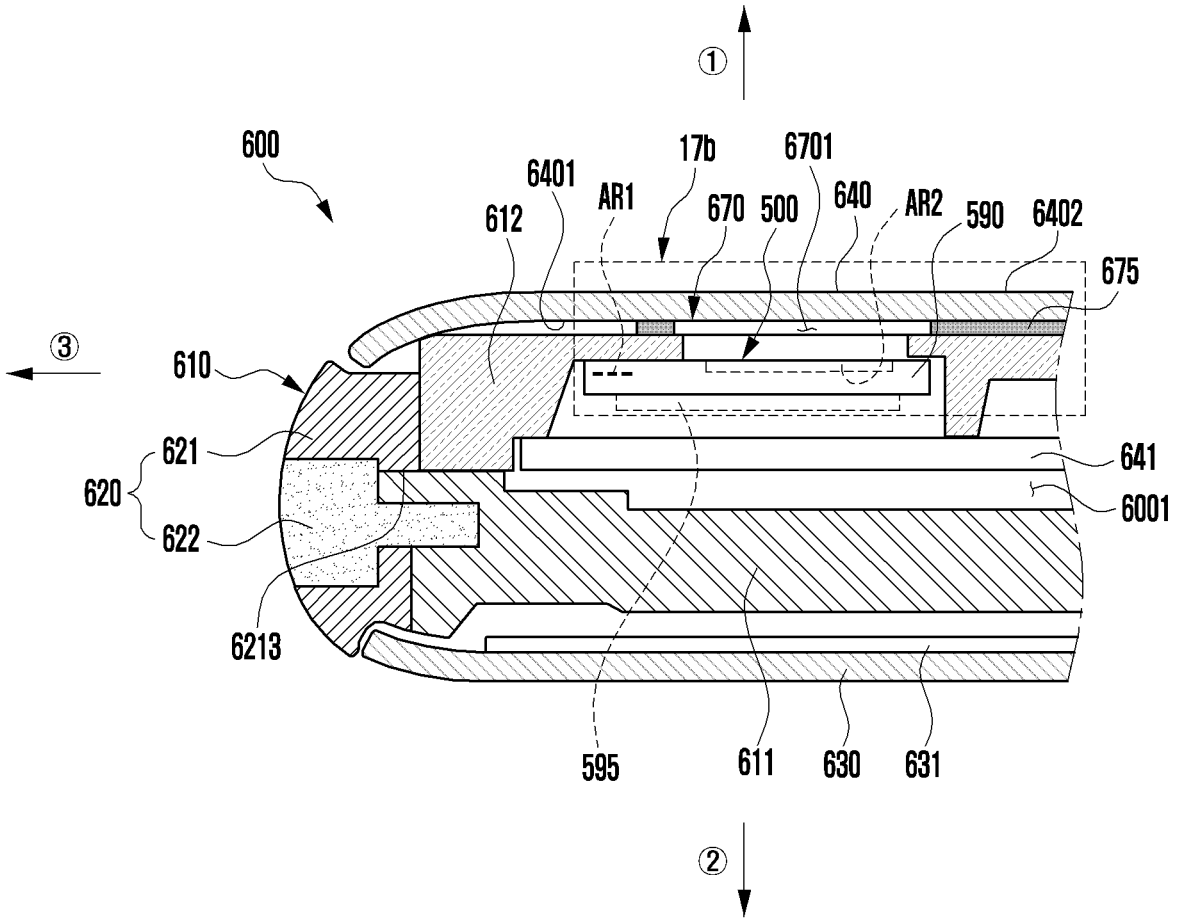
FIG. 17A is a cross-sectional view partially illustrating an electronic device including a conductor according to various embodiments of the disclosure.
Figure 17B:
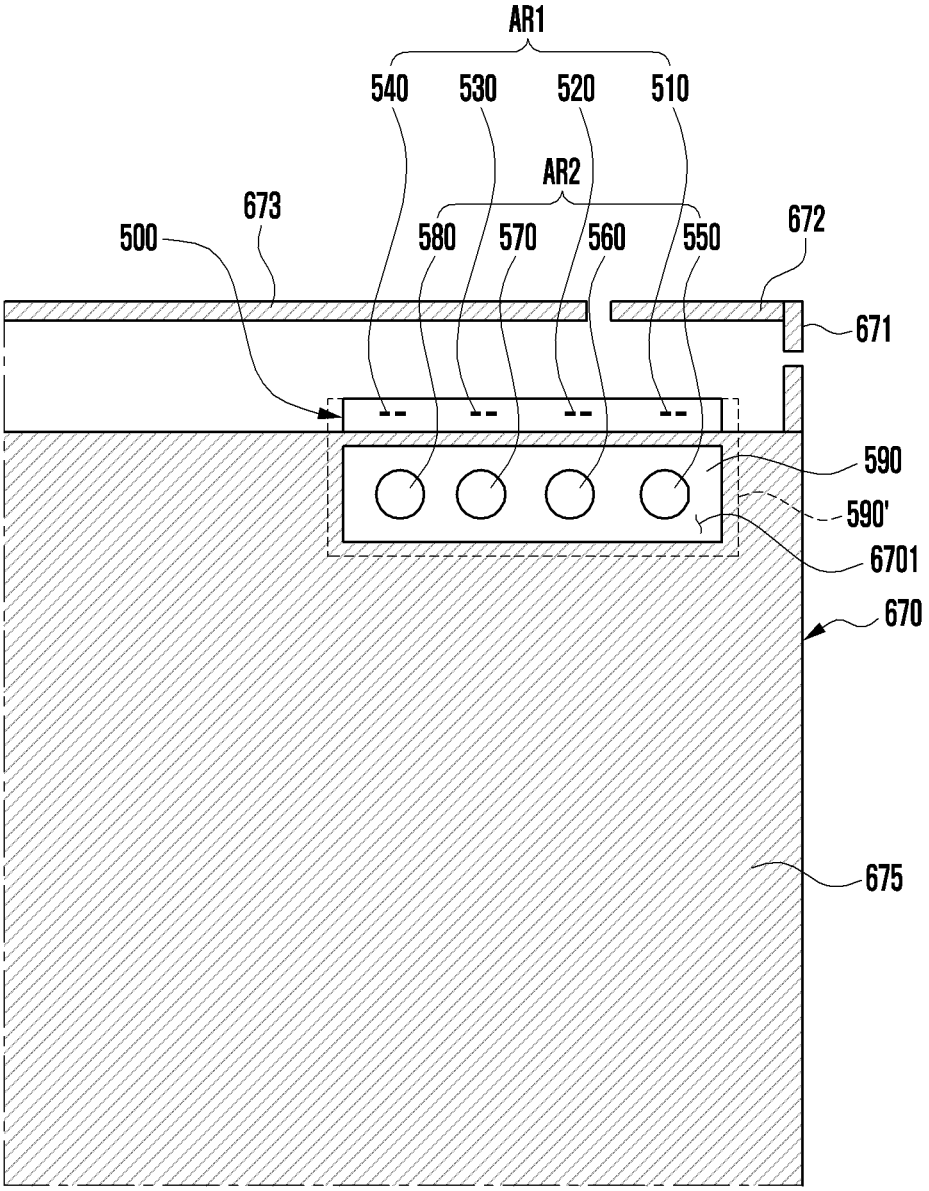
FIG. 17B is an enlarged plan view of a region 17B of FIG. 17A to illustrate an arrangement of an antenna structure and a conductor according to an embodiment of the disclosure.

FIG. 17A is a cross-sectional view partially illustrating an electronic device including a conductor according to an embodiment of the disclosure. FIG. 17B is an enlarged plan view of a region 17B of FIG. 17A to illustrate an arrangement of an antenna structure and a conductor according to an embodiment of the disclosure.

In the electronic device 600 of FIG. 17A, components that are substantially the same as those of the electronic device 600 of FIG. 13 are denoted by the same reference numerals, and detailed descriptions thereof may be omitted.

Referring to FIGS. 17A and 17B, the electronic device 600 may include a conductor 670 that is disposed in the inner space 6001 and has a conductive portion 675 and an opening 6701 formed through the conductive portion 675. According to an embodiment of the disclosure, the conductor 670 may be disposed at a position that allows the opening 6701 to be overlapped at least in part with the second antenna array AR2 when the rear cover 640 is viewed from above. For example, the opening 6701 may have a size equal to or greater than that of the second antenna array AR2.

According to various embodiments of the disclosure, the conductor 670 may be replaced with a conductive support member that supports the rear cover 640 in the inner space 6001 of the electronic device 600. In this case, the conductor 670 may be disposed between the antenna support member 612 and the rear cover 640, and may include the conductive portion 675 having a similar area to the rear cover 640 and/or the antenna support member 612. According to an embodiment of the disclosure, when the rear cover 640 is viewed from above, the opening 6701 may be formed at a position overlapped with the second antenna array AR2 including the plurality of conductive patches 550, 560, 570, and 580. In this case, at least a part of the conductive portion 675 forming the opening 6701 may operate as a conductor (e.g., reflector) for the first antenna array AR1 including the plurality of conductive patterns 510, 520, 530, and 540. According to an embodiment of the disclosure, the rear cover may include a dielectric material (e.g., a ceramic material) having a high dielectric constant (e.g., a dielectric constant of 5 or more). In another embodiment of the disclosure, the conductor 670 may be formed on the inner surface of the rear cover 640 (e.g., formed of a ceramic material) through a patterning process. In this case, the antenna support member 612 may be omitted.

According to various embodiments of the disclosure, the opening 6701 may have substantially the same size (e.g., width) as that of the PCB 590. In another embodiment of the disclosure, the opening 6701 may be smaller than the PCB 590 while being overlapped with the second antenna array AR2.

According to various embodiments of the disclosure, the conductive portion 675 may include one or more extended portions 671, 672, and 673 extended outward. According to an embodiment of the disclosure, the extended portions 671, 672, and 673 and/or at least a part of the conductive portion 675 may be electrically connected to a wireless communication circuit (e.g., the wireless communication module 192 in FIG. 1) of the electronic device 600, and thereby used as an antenna that operates in a specific frequency band (e.g., legacy band).

The conductor (e.g., a reflector) according to various embodiments of the disclosure is capable of reducing a radiation loss due to a nearby conductive structure, thereby allowing a beam pattern to be formed in a desired direction of the antenna structure, securing an efficient mounting space of the antenna structure in the inner space of the electronic device, and preventing the radiation performance from being degraded.

According to various embodiments of the disclosure, an electronic device (e.g., the electronic device 600 in FIG. 6) may include a housing (e.g., the housing 610 in FIG. 6) having an inner space (e.g., the inner space 6001 in FIG. 6). The electronic device may further include an antenna structure (e.g., the antenna structure 500 in FIG. 6) disposed in the inner space of the housing and including a printed circuit board (PCB) (e.g., the PCB 590 in FIG. 5) having a first board surface (e.g., the first board surface 591 in FIG. 5) facing a first direction (e.g., denoted by ① in FIG. 6), a second board surface (e.g., the second board surface 592 in FIG. 5) facing a second direction (e.g., denoted by ② in FIG. 6) opposite to the first direction, and a lateral board surface (e.g., the lateral board surface 593 in FIG. 5) surrounding a space between the first and second board surfaces, a first antenna array (e.g., the first antenna array AR1 in FIG. 5) disposed in the space between the first and second board surfaces and forming a beam pattern in a third direction (e.g., denoted by ③ in FIG. 6) that the lateral board surface faces, and a second antenna array (e.g., the second antenna array AR2 in FIG. 5) disposed at a position spaced apart from the first antenna array and forming a beam pattern in the first direction. The electronic device may further include a conductor (e.g., the conductor 650 in FIG. 5) including a conductive portion and disposed between the first and second antenna arrays in the inner space of the housing when the first board surface is viewed from above. The electronic device may further include a first wireless communication circuit (e.g., the wireless communication circuit 595 in FIG. 5) disposed in the inner space of the housing and configured to transmit and/or receive a radio signal of a first frequency range through the first and second antenna arrays.

According to various embodiments of the disclosure, the first frequency range may include a frequency range of about 3 GHz to about 100 GHz.

According to various embodiments of the disclosure, the conductor may be disposed higher than the first antenna array and/or the second antenna array in the first direction when the lateral board substrate is viewed.

According to various embodiments of the disclosure, the conductor may have a length (e.g., the length L1 in FIG. 7) equal to or greater than an arrangement length (e.g., the arrangement length L2 in FIG. 7) of the first antenna array when the first board surface is viewed from above.

According to various embodiments of the disclosure, the conductor may be disposed on a dielectric structure (e.g., the antenna support member 612 in FIG. 6) disposed in the inner space of the housing.

According to various embodiments of the disclosure, the conductor may include at least one of a laser direct structuring (LDS) pattern, a metal sheet, a conductive tape, or a conductive paint, which is disposed on the dielectric structure.

According to various embodiments of the disclosure, the conductor may be disposed on the first board surface of the PCB.

According to various embodiments of the disclosure, the conductor may be disposed inside the housing, an inner surface of the housing, and/or an outer surface of the housing.

According to various embodiments of the disclosure, the conductor may include a first divided conductive portion (e.g., the first portion 6511 in FIG. 10A) and a second divided conductive portion (e.g., the second portion 6512 in FIG. 10A).

According to various embodiments of the disclosure, the first antenna array may include a first antenna element (e.g., the first conductive pattern 510 in FIG. 10A) and a second antenna element (e.g., the second conductive pattern 520 in FIG. 10A). In this case, the first conductive portion may be disposed at a position corresponding to the first antenna element, and the second conductive portion may be disposed at a position corresponding to the second antenna element.

According to various embodiments of the disclosure, the electronic device may further include a second wireless communication circuit (e.g., the wireless communication circuit 192 in FIG. 1) configured to transmit and/or receive a radio signal of a second frequency range through at least a part of the conductor.

According to various embodiments of the disclosure, the second frequency range may include a frequency range of about 400 MHz to about 3000 MHz.

According to various embodiments of the disclosure, the conductor may include at least two divided conductive portions, and the second wireless communication circuit may be electrically connected to one of the at least two conductive portions.

According to various embodiments of the disclosure, the conductive portion connected to the second wireless communication circuit may include at least one extended portion (e.g., the first extended portion 6573 and/or the second extended portion 6574 in FIG. 10G) extended from an end of the conductive portion in a specific direction, and frequency characteristics may be determined based on a shape of the at least one extended portion.

According to various embodiments of the disclosure, the conductor may include at least one extended portion (e.g., the extended portions 6522 and 6523 in FIG. 10B) extended from one end and/or both ends of the conductor in the first direction and/or the second direction.

According to various embodiments of the disclosure, each of the first and second antenna arrays may include, as at least one antenna element, at least one conductive pattern and/or at least one conductive patch.

According to various embodiments of the disclosure, the housing may include a front cover (e.g., the front cover 630 in FIG. 6), a rear cover (e.g., the rear cover 640 in FIG. 6) facing in a direction opposite to the front cover, and a lateral member (e.g., the lateral member 620 in FIG. 6) surrounding the inner space between the front and rear covers and having at least in part a conductive portion (e.g., the conductive portion 621 in FIG. 6), and the second antenna array may be arranged to form a beam pattern in a direction toward the rear cover.

According to various embodiments of the disclosure, the rear cover may be formed of a material having a dielectric constant of 5 or more.

According to various embodiments of the disclosure, the rear cover may be formed of a ceramic material.

According to various embodiments of the disclosure, the electronic device may further include a display (e.g., the display 631 in FIG. 6) disposed in the inner space to be visible from outside through at least a part of the front cover.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. An electronic device comprising:

a housing having an inner space;

an antenna structure disposed in the inner space of the housing and including:

a printed circuit board (PCB) having a first board surface facing a first direction, a second board surface facing a second direction opposite to the first direction, and a lateral board surface surrounding a space between the first and second board surfaces;

a first antenna array disposed in the space between the first and second board surfaces and forming a beam pattern in a third direction that the lateral board surface faces; and a second antenna array disposed at a position spaced apart from the first antenna array and forming a beam pattern in the first direction;

a conductor including a conductive portion and disposed between the first and second antenna arrays in the inner space of the housing when the first board surface is viewed from above; and a first wireless communication circuit disposed in the inner space of the housing and configured to transmit and receive a radio signal of a first frequency range through the first and second antenna arrays.

2. The electronic device of claim 1, wherein the first frequency range includes a frequency range of about 3 GHz to about 100 GHz.

3. The electronic device of claim 1, wherein the conductor is disposed higher than the first antenna array and the second antenna array in the first direction when the lateral board substrate is viewed.

4. The electronic device of claim 1, wherein the conductor has a length equal to or greater than an arrangement length of the first antenna array when the first board surface is viewed from above.

5. The electronic device of claim 1, wherein the conductor is disposed on a dielectric structure disposed in the inner space of the housing.

6. The electronic device of claim 5, wherein the conductor includes at least one of a laser direct structuring (LDS) pattern, a metal sheet, a conductive tape, or a conductive paint, which is disposed on the dielectric structure.

7. The electronic device of claim 1, wherein the conductor is disposed on the first board surface of the PCB.

8. The electronic device of claim 1, wherein the conductor is disposed inside the housing, an inner surface of the housing, and an outer surface of the housing.

9. The electronic device of claim 1, wherein the conductor includes a first divided conductive portion and a second divided conductive portion.

10. The electronic device of claim 9, wherein the first antenna array includes a first antenna element and a second antenna element, and wherein the first conductive portion is disposed at a position corresponding to the first antenna element, and the second conductive portion is disposed at a position corresponding to the second antenna element.

11. The electronic device of claim 1, further comprising:

a second wireless communication circuit configured to transmit and receive a radio signal of a second frequency range through at least a part of the conductor.

12. The electronic device of claim 11, wherein the second frequency range includes a frequency range of about 400 MHz to about 3000 MHz.

13. The electronic device of claim 11, wherein the conductor includes at least two divided conductive portions, and wherein the second wireless communication circuit is electrically connected to one of the at least two conductive portions.

14. The electronic device of claim 13, wherein the conductive portion connected to the second wireless communication circuit includes at least one extended portion extended from an end of the conductive portion in a specific direction, and wherein frequency characteristics are determined based on a shape of the at least one extended portion.

15. The electronic device of claim 1, wherein the conductor includes at least one extended portion extended from one end and both ends of the conductor in the first direction and the second direction.

16. The electronic device of claim 1, wherein each of the first and second antenna arrays includes, as at least one antenna element, at least one conductive pattern and at least one conductive patch.

17. The electronic device of claim 1, wherein the housing includes a front cover, a rear cover facing in a direction opposite to the front cover, and a lateral member surrounding the inner space between the front and rear covers and having at least in part the conductive portion, and wherein the second antenna array is arranged to form a beam pattern in a direction toward the rear cover.

18. The electronic device of claim 17, wherein the rear cover is formed of a material having a dielectric constant of 5 or more.

19. The electronic device of claim 17, wherein the rear cover is formed of a ceramic material.

20. The electronic device of claim 17, further comprising:

a display disposed in the inner space to be visible from outside through at least a part of the front cover.

* * * * *